US007427004B2

(12) United States Patent
Shanklin et al.

(10) Patent No.: US 7,427,004 B2
(45) Date of Patent: Sep. 23, 2008

(54) HAND HELD PRESSURIZED SPRAYER

(75) Inventors: Donald J. Shanklin, Corona, CA (US); Ronald F. Englhard, Dove Canyon, CA (US)

(73) Assignee: MeadWestvaco Calmar, Inc., Grandview, MO (US)

( * ) Notice: Subject to any disclaimer, the term of this patent is extended or adjusted under 35 U.S.C. 154(b) by 172 days.

(21) Appl. No.: 10/969,801

(22) Filed: Oct. 20, 2004

(65) Prior Publication Data

US 2005/0139618 A1 Jun. 30, 2005

Related U.S. Application Data

(60) Provisional application No. 60/512,616, filed on Oct. 20, 2003.

(51) Int. Cl.
*B65D 83/00* (2006.01)

(52) U.S. Cl. ..... 222/401; 239/333

(58) Field of Classification Search ..... 222/401, 222/402, 402.1, 321.7, 321.9, 340, 341, 385, 222/386, 383.1, 386.5, 402.16, 102.15, 321.8; 239/327, 328, 333
See application file for complete search history.

(56) References Cited

U.S. PATENT DOCUMENTS

| | | | |
|---|---|---|---|
| 665,914 | A | 1/1901 | Kindermann |
| 1,417,951 | A | 5/1922 | Staples et al. |
| 1,671,779 | A | 5/1928 | Pearsons |
| 1,681,845 | A | 8/1928 | Dilley et al. |
| 1,730,684 | A | 10/1929 | Phillips |
| 1,814,504 | A | 7/1931 | Collins |
| 2,048,142 | A | 7/1936 | Santurello |
| 2,060,297 | A | 11/1936 | Fox |
| 2,096,042 | A | 10/1937 | Irwin |
| 2,198,933 | A | 4/1940 | Damkroger et al. |
| 2,232,522 | A | 2/1941 | Gray |
| 2,341,031 | A | 2/1944 | Flynn |
| 2,342,288 | A | 2/1944 | Mai |
| 2,474,748 | A | 6/1949 | McMurray |
| 2,521,164 | A | 9/1950 | Hayes |
| 2,537,872 | A | 1/1951 | Wright |
| 2,545,319 | A | 3/1951 | Sundholm |
| 2,865,540 | A | 12/1958 | Gray |
| 2,881,810 | A | 4/1959 | Breitenstein |
| 3,002,699 | A | 10/1961 | Pinke |
| 3,092,330 | A | 6/1963 | Ridenour et al. |
| 3,129,856 | A | 4/1964 | Jokelson |

(Continued)

FOREIGN PATENT DOCUMENTS

| | | |
|---|---|---|
| EP | 963912 | 7/1964 |

(Continued)

OTHER PUBLICATIONS

Copending U.S. Appl. No. 11/224,677, filed on Sep. 12, 2005.

*Primary Examiner*—Lien M. Ngo

(57) ABSTRACT

A pressurized sprayer comprises a pump attachment. The pump attachment includes a body that defines a chamber in which a piston is reciprocally mounted. The piston is coupled to a handle by a shaft. The piston separates the chamber into a first portion and as second portion. The second portion in communication with an inlet valve and outlet passage. A spray nozzle is in communication with the outlet passage and is rigidly attached to the pump attachment.

18 Claims, 18 Drawing Sheets

U.S. PATENT DOCUMENTS

| | | | |
|---|---|---|---|
| 3,299,960 | A | 1/1967 | Stern |
| 3,584,834 | A | 6/1971 | Reid et al. |
| 3,730,398 | A | 5/1973 | Goda |
| 3,792,800 | A | 2/1974 | Capra et al. |
| 3,797,748 | A | 3/1974 | Nozawa et al. |
| 3,901,449 | A | 8/1975 | Bochmann |
| 3,921,861 | A | 11/1975 | Kondo |
| 3,940,029 | A | 2/1976 | Horvath |
| 4,050,860 | A | 9/1977 | Beres |
| 4,105,145 | A | 8/1978 | Capra |
| 4,109,832 | A | 8/1978 | Kutik et al. |
| 4,155,489 | A | 5/1979 | Steiman |
| 4,167,941 | A | 9/1979 | Capra et al. |
| 4,174,055 | A | 11/1979 | Capra et al. |
| 4,176,764 | A | 12/1979 | Capra et al. |
| 4,183,449 | A | 1/1980 | Blake |
| 4,192,464 | A | 3/1980 | Chow |
| 4,210,261 | A | 7/1980 | Trujillo et al. |
| 4,222,500 | A | 9/1980 | Capra et al. |
| 4,222,501 | A | 9/1980 | Hammett et al. |
| 4,231,493 | A | 11/1980 | Kutik et al. |
| 4,235,353 | A | 11/1980 | Capra et al. |
| 4,260,082 | A | 4/1981 | Rooney et al. |
| 4,271,990 | A | 6/1981 | Kutik et al. |
| 4,316,600 | A | 2/1982 | Parise et al. |
| 4,325,499 | A | 4/1982 | Shay |
| 4,325,500 | A | 4/1982 | Shay |
| 4,325,501 | A | 4/1982 | Shay |
| 4,350,299 | A | 9/1982 | Stephenson et al. |
| 4,392,594 | A | 7/1983 | Swett et al. |
| 4,420,097 | A | 12/1983 | Motsenbocker |
| 4,524,888 | A | 6/1985 | Tada |
| 4,618,099 | A | 10/1986 | Nagao et al. |
| 4,635,830 | A | 1/1987 | Wehr |
| 4,809,878 | A | 3/1989 | Rainey |
| 4,863,302 | A | 9/1989 | Herzfeld et al. |
| 4,872,595 | A | 10/1989 | Hammett et al. |
| 4,899,913 | A | 2/1990 | Ruscitti |
| 4,901,878 | A | 2/1990 | Humphries |
| 4,930,686 | A | 6/1990 | Ellison |
| 4,964,547 | A | 10/1990 | Lina |
| 5,064,168 | A | 11/1991 | Raines et al. |
| 5,183,189 | A | 2/1993 | Baudin |
| 5,363,993 | A | 11/1994 | Mascitelli et al. |
| 5,373,973 | A | 12/1994 | Foster |
| 5,375,745 | A | 12/1994 | Ritsche |
| 5,381,932 | A | 1/1995 | Humphrey |
| 5,395,032 | A | 3/1995 | Fuchs |
| 5,419,463 | A | 5/1995 | Mizushima et al. |
| 5,429,275 | A | 7/1995 | Katz |
| 5,469,993 | A | 11/1995 | Hauf et al. |
| 5,485,942 | A | 1/1996 | Foster |
| 5,497,944 | A | 3/1996 | Weston et al. |
| 5,553,750 | A | 9/1996 | Foster |
| 5,601,211 | A | 2/1997 | Foster |
| 5,609,272 | A | 3/1997 | Brass et al. |
| 5,649,664 | A | 7/1997 | Brass et al. |
| 5,651,908 | A | 7/1997 | Mansfield |
| 5,676,314 | A | 10/1997 | Brass et al. |
| 5,755,361 | A | 5/1998 | Restive et al. |
| 5,810,211 | A | 9/1998 | Shanklin et al. |
| 5,816,447 | A | 10/1998 | Shanklin et al. |
| D402,205 | S | 12/1998 | Shanklin et al. |
| 5,860,574 | A | 1/1999 | Shanklin et al. |
| D407,312 | S | 3/1999 | Shanklin et al. |
| 5,918,782 | A | 7/1999 | Shanklin et al. |
| 5,938,116 | A | 8/1999 | Restive et al. |
| 6,089,414 | A | 7/2000 | Shanklin et al. |
| 6,095,434 | A | 8/2000 | Mentenegro |
| 6,170,706 | B1 | 1/2001 | Havlovitz |
| 6,217,331 | B1 | 4/2001 | Rogers et al. |
| 6,264,120 | B1 | 7/2001 | Wintering et al. |
| 6,296,154 | B1 | 10/2001 | Shanklin et al. |
| 6,322,051 | B1 | 11/2001 | Salmela |
| 6,405,907 | B1 | 6/2002 | Roberts |
| 6,415,956 | B1 | 7/2002 | Havlovitz |
| 6,953,133 | B2 | 10/2005 | Englhard et al. |
| 2006/0060613 | A1 | 3/2006 | Englhard et al. |

FOREIGN PATENT DOCUMENTS

| | | |
|---|---|---|
| EP | 0 583 902 A1 | 2/1994 |
| GB | 2 269 796 A | 2/1994 |
| WO | WO 94/03278 | 2/1994 |
| ZA | 98/5738 | 8/1993 |

HAND HELD PRESSURIZED SPRAYER

PRIORITY INFORMATION

This application claims the priority benefit under 35 U.S.C. § 119(e) of Provisional Application 60/512,616 filed Oct. 20, 2003.

BACKGROUND OF THE INVENTION

1. Field of the Invention

This invention relates to pumps and, in particular, to nonaerosol pump sprayers.

2. Description of the Related Art

Noncontainer pressurizing pump sprayers commonly utilize an integral cylinder and plunger arrangement to generate pressure to expel liquid, such as insecticide and fertilizer from a container. Noncontainer pressurizing pump sprayers are desirable in that they do not utilize pressurized containers which must be handled carefully and at controlled temperatures to avoid the risk of explosion. Noncontainer pressurizing pump sprayers have a number of other advantages, including not using propellants which destroy the ozone and being relatively inexpensive.

There are two common varieties of noncontainer pressurizing pump sprayers: pump sprayers that are pressurized on the upstroke and pump sprayers that are pressurized on the downstroke. Pump sprayers that are pressurized on the downstroke typically utilize a return spring which biases the plunger upward after the pressurization stroke. Examples of such noncontainer pressurizing pumps can be found in U.S. Pat. Nos. 4,174,055 and 6,296,154. While these arrangements have been successful, noncontainer pressurizing pumps are still relatively complicated and expensive devices. As such, there is a general need to develop noncontainer pressuring pumps that utilize fewer parts and/or can be made out of less expensive materials.

SUMMARY OF THE INVENTION

An embodiment of the present invention comprises a pump attachment for a container. The attachment includes a body having a first end and a second end and defines a chamber formed in part by an interior wall extending between the first end and the second end. A shaft extends into the chamber through an opening in the first end of the body. A piston is reciprocally mounted within the chamber and is coupled to the shaft. The piston includes an upper surface and a lower surface. The piston is in sealing engagement with the interior wall of the body. The piston separates the chamber into an upper portion above the upper surface of the piston and a lower portion below the lower surface of the piston. A handle is coupled to the piston through the shaft. An inlet valve is at the second end of the body. The inlet valve is configured to permit the flow of fluid into the chamber and restrict the flow of fluid out of the chamber. A biasing member is positioned within the chamber between the piston and the first end of the body. An outlet passage is at the second end of the body. A conduit is in fluid communication with the outlet passage. A spray nozzle comprises an actuator and a discharge outlet The actuator is coupled to a spray valve for controlling the flow of chemical from the conduit through the spray nozzle to the discharge outlet. The spray nozzle is rigidly coupled to the container while the discharge outlet defines a spray pattern having a generally horizontal direction with respect to the user of the pump.

Another embodiment of the invention comprises a pressurized sprayer. The sprayer comprises a body that defines a chamber and having a first end and a second end and a wall extending between the first end and the second end. The first end of the body is coupled to an opening of a container. A shaft extending through an opening in the first end of the chamber. A piston is reciprocally mounted within the chamber. The piston includes an upper surface and a lower surface. The piston is in sealing engagement with the interior wall of the body. The piston separates the chamber into an upper portion above the upper surface of the piston and a lower portion below the lower surface of the piston. A handle is coupled to the piston through the shaft. An inlet valve is at the second end of the body. The inlet valve is configured to permit the flow of fluid into the chamber and to restrict the flow of fluid out of the chamber. A biasing member is positioned between the piston and the first end of the elongate chamber. An outlet passage is at the second end of the body. A flexible first conduit is in fluid communication with the outlet passage. An internal passage is formed in the first end of the body. The passage has an outlet and an inlet that is coupled to the first conduit to place the passage in communication with the outlet passage. A spray nozzle comprises an actuator, a discharge outlet, and a flexible second conduit. The second flexible conduit extends between the outlet of the internal passage and the discharge outlet to place the discharge outlet in communication with the outlet passage. The actuator is coupled to a spray valve for controlling the flow of chemical through the second conduit.

Although this invention has been described in terms of certain preferred embodiments, other embodiments that will be apparent to those of ordinary skill in the art are intended to be within the scope of this invention. Accordingly, the scope of the invention is intended to be defined by the claims that follow.

BRIEF DESCRIPTION OF THE DRAWINGS

These and other aspects of the invention will now be discussed in connection with the accompanying drawings, which form a part hereof.

DETAILED DESCRIPTION OF THE PREFERRED EMBODIMENTS

Figure 1:
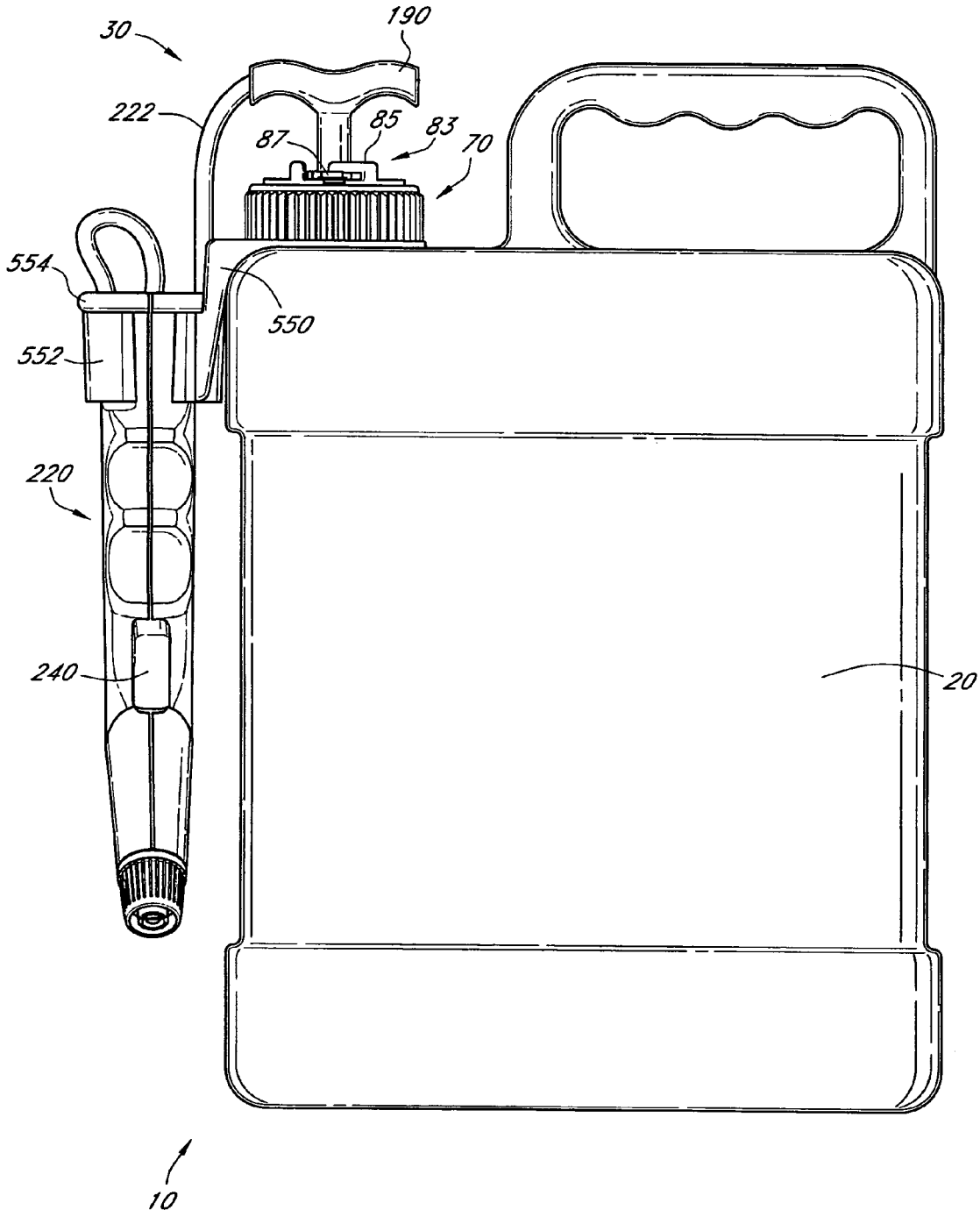
FIG. 1 is side perspective view of an example embodiment of a pump attachment attached to a chemical container.
Figure 2:
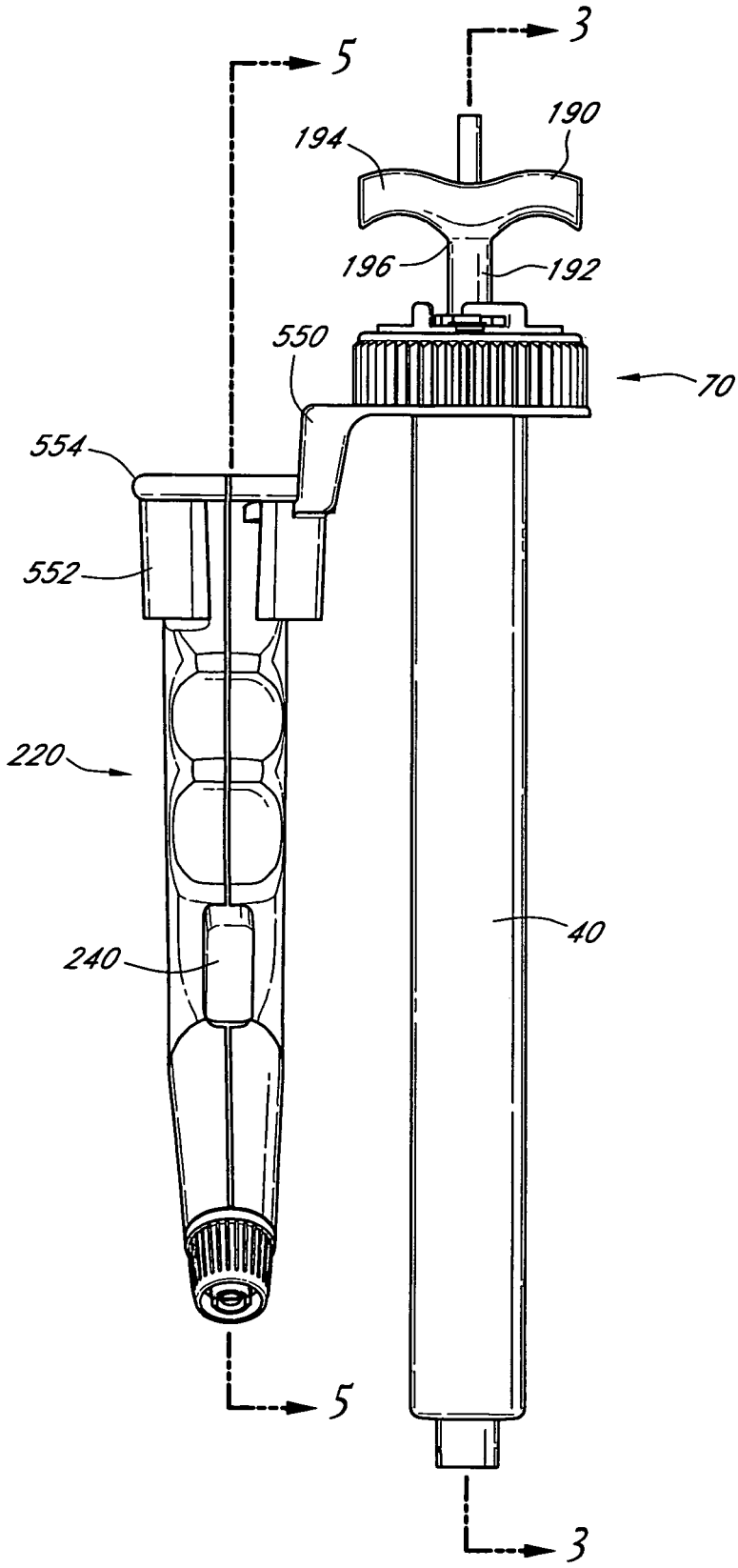
FIG. 2 is side view of the pump attachment of FIG. 1.

FIG. 1 illustrates assembly 10 that includes a container 20 and an example embodiment of a pump attachment 30, which is also shown in FIG. 2. The container 20 defines an internal space or reservoir (not shown) for storing a chemical.

Figure 3:
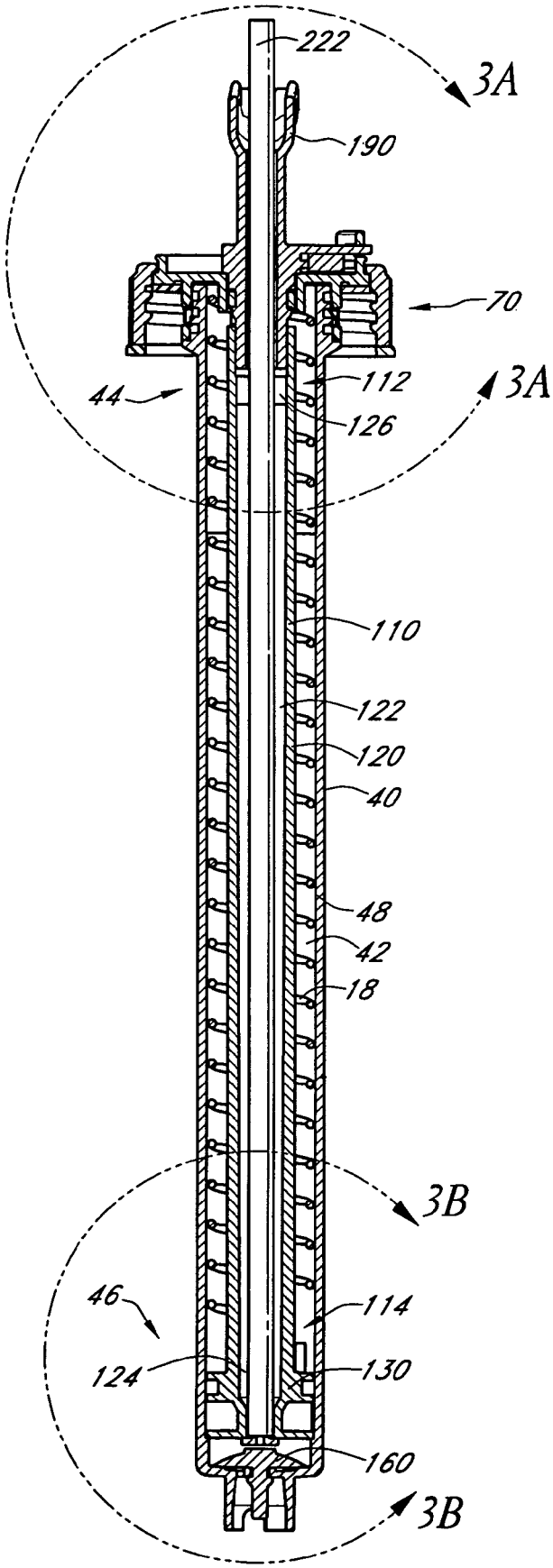
FIG. 3 is a cross-sectional view taken along line 3-3 of FIG. 2.

With reference to FIGS. 1-3, the attachment 30 includes a body 40, which is inserted into the container through a port or opening. The attachment 30 is secured to the container 20 by a threaded coupler 70. The attachment 30 further includes a shaft 110 which, in the illustrated embodiment, is integrally formed with or connected to a piston 130. A handle 190 is mounted on or integrally formed with the shaft 110. Tubing 222, which will be described in more detail below, extends between the body 40 and a wand or spray nozzle 220. The nozzle 220 includes a release valve (described below), which controls the flow of fluid through the spray nozzle 220 and an actuator 240 for controlling the release valve.

Figure 3A:
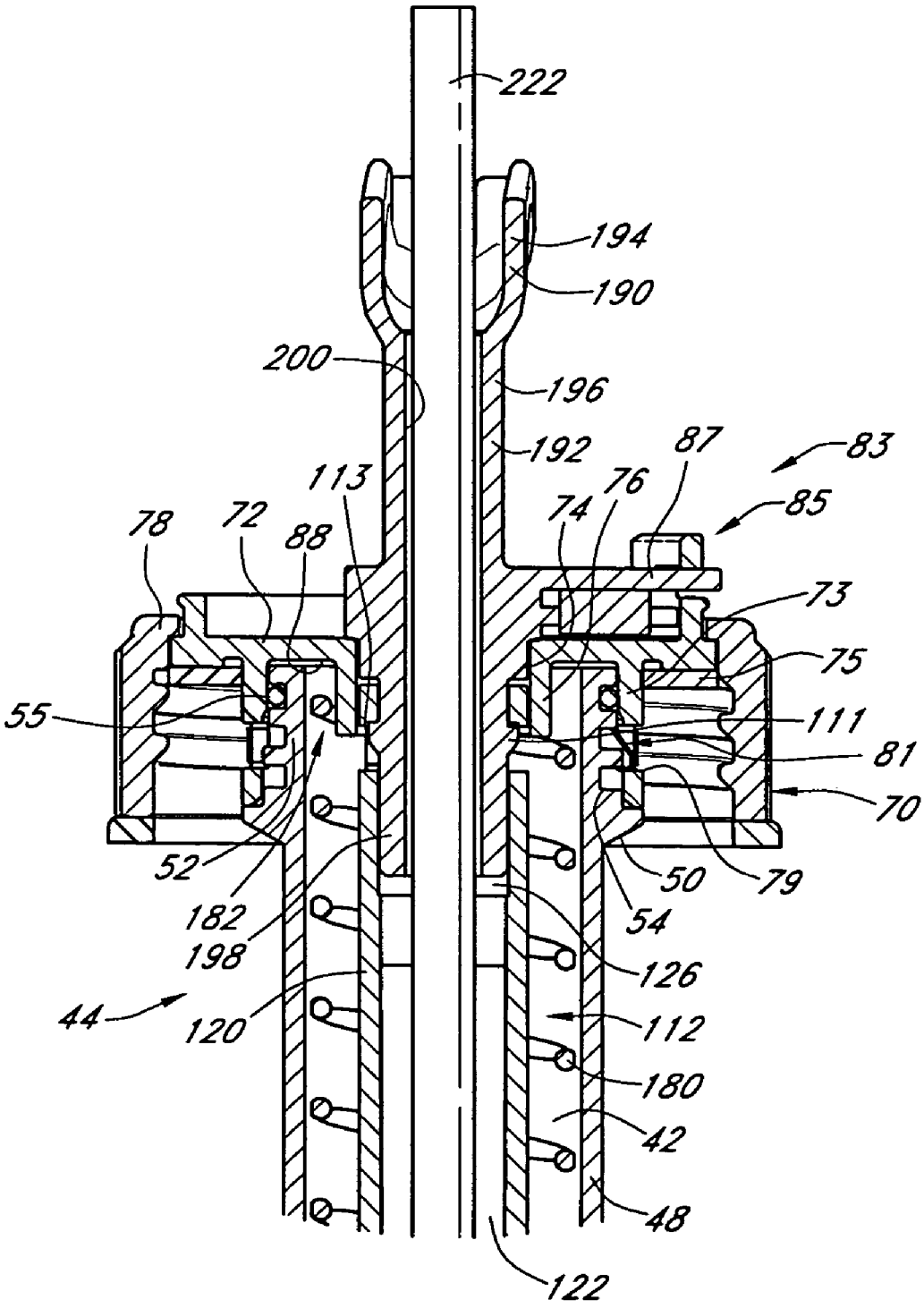
FIG. 3A is an enlarged view of an upper portion of FIG. 3.
Figure 3B:
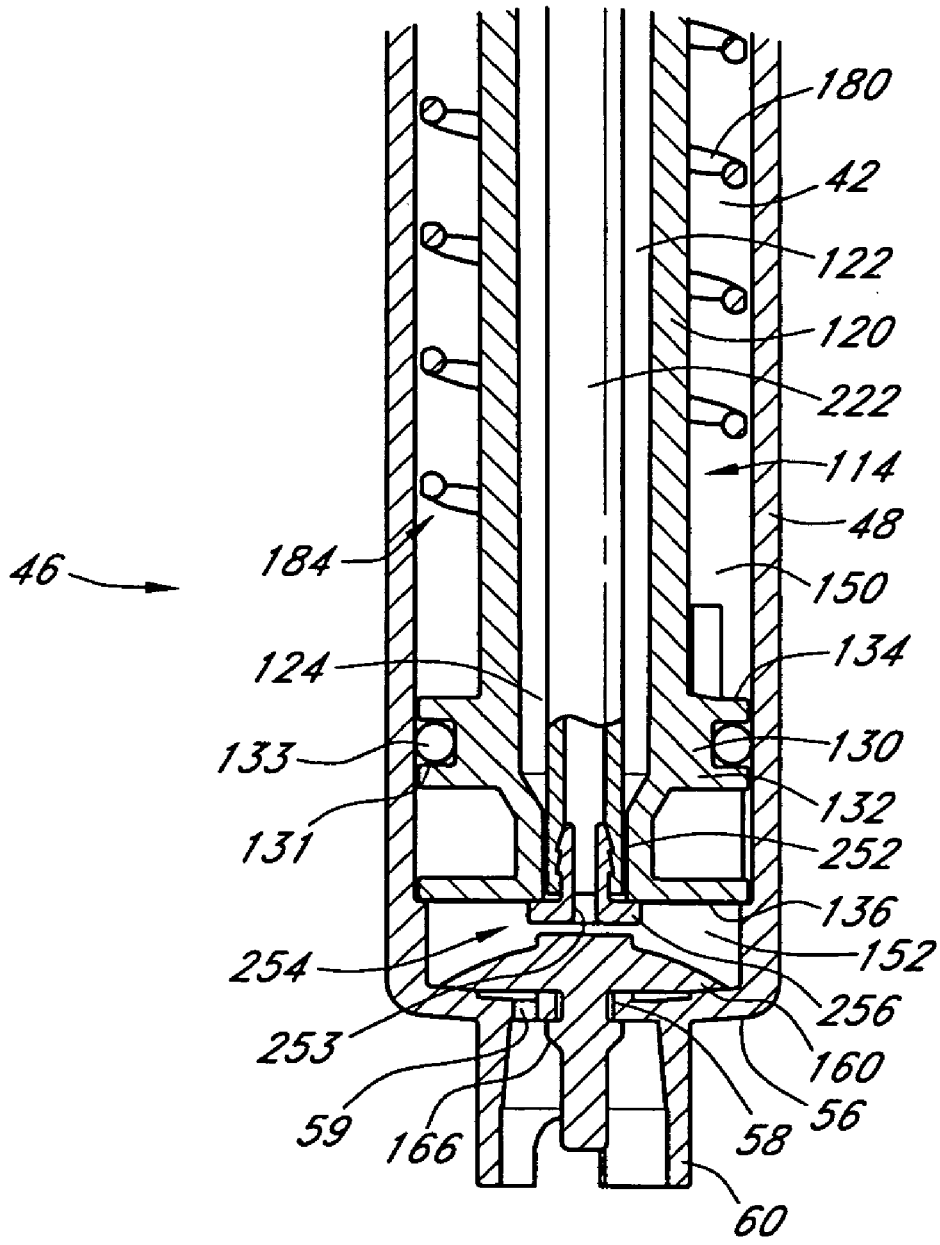
FIG. 3B is an enlarged view of a lower portion of FIG. 3.

With reference to FIGS. 2-3B, the body 40 of the attachment 30 will now be described in detail. The body 40 defines an internal chamber 42. The body 40 includes first or upper end 44, a second or lower end 46 and a cylindrical internal wall 48. As seen in FIG. 3A, The upper end 44 of the body 40 includes an outwardly tapering portion 50 and an upper cylindrical flange 52, provided with a recess 54 for receiving an O-ring 55. As seen in FIG. 3B, the lower end 46 of the body 40 is provided with an annular overhanging lip 56, which defines an opening 58 and a depending flange 60 extending downward from the annular lip 56 surrounding the opening 58.

Figure 4:
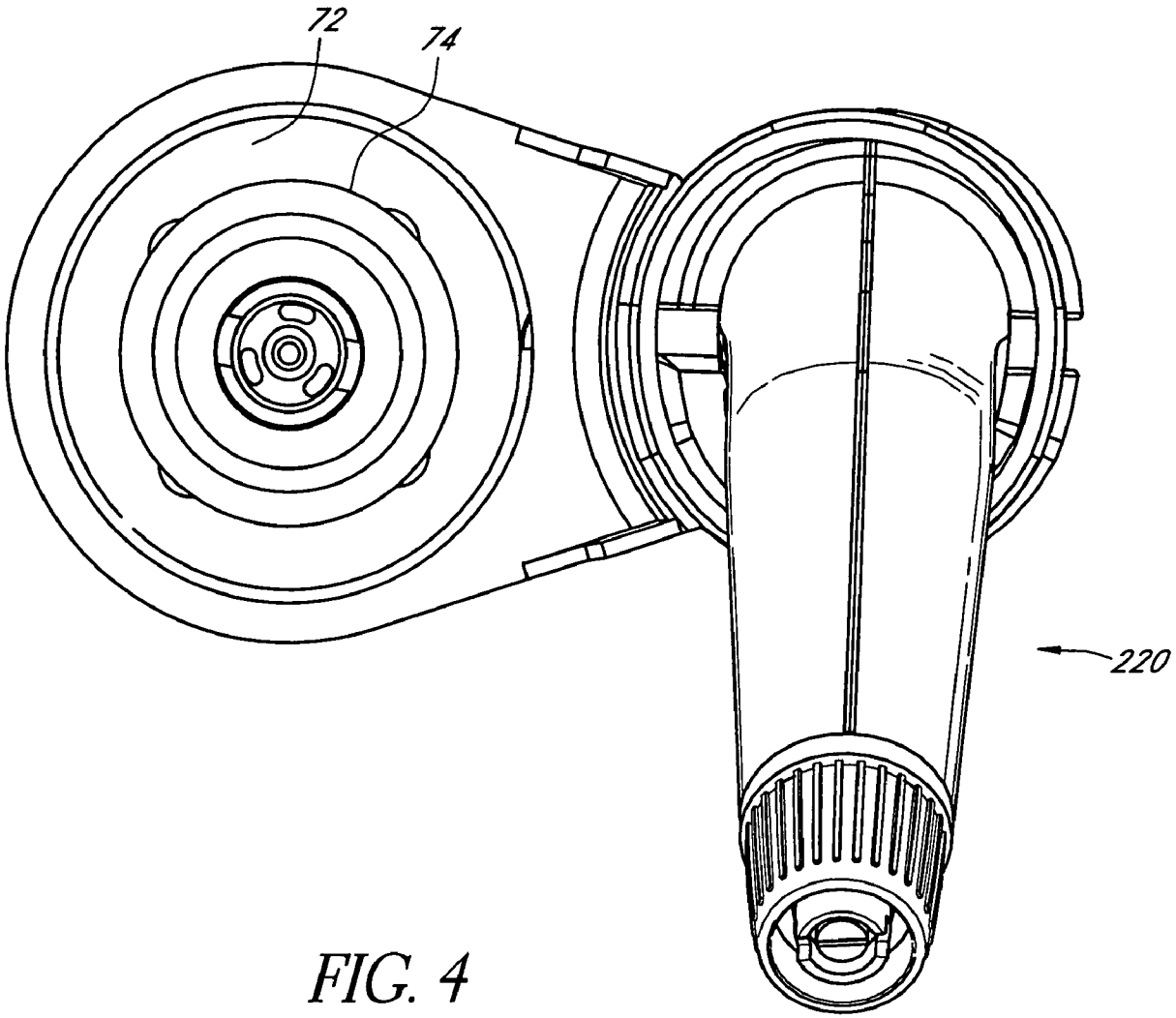
FIG. 4 is bottom view of the pump attachment of FIG. 1.

The coupler 70 (see FIGS. 3A and 4) includes a disk-shaped cap 72 that includes an downwardly projecting flange 76, which partially defines a central aperture 74 and fits over the shaft 110. The cap 72 also includes an annular extension 73, which is configured to fit over and around the upper cylindrical flange 52 of the body 40. In the illustrated embodiment, the annular extension 73 includes an annular opening 79 which interacts with an annular ridge 81 on the upper cylindrical flange 52 of the body 40 in a snap fit. The coupler 70 includes an annular lip 78, which fits over the cap 72. A gasket 75 is positioned between the cap 72 and the container 20. With reference to FIGS. 1 and 3A, the illustrated coupler 70 advantageously includes a handle locking mechanism 83, which comprises an annular lip 85, which interacts with a tap 87 on the handle 190 to lock the handle 190 in place.

As shown in FIG. 3, the shaft 110 has a first or upper end 112 and a second or lower end 114. In the illustrated embodiment, the upper end 112 is configured such that the handle 190 can be press-fitted into the shaft 110 (see FIG. 3A). The lower end 114 of the shaft 110 advantageously defines the piston 130 (see FIG. 3B). In modified embodiments, the piston 130 can be coupled to the shaft 110. In the illustrated embodiment, the piston 130 includes a recess 131 for receiving a sealing member 133 (e.g., an O-ring). The piston 130 includes a body 132 having a top 134 and bottom 136. In the illustrated embodiment, the shaft 110 includes an internal wall 120 which defines a channel 122 having a lower inlet end 124 and an upper outlet end 126. In a modified embodiment, the shaft 120 may be formed from a one or more elongated members that couple the handle 190 to the piston 130. In such an arrangement, the shaft 110 may not define a channel 122 and/or the channel 122 may be in communication with the internal chamber 42. Advantageously, the shaft 110 provides a relatively rigid connection between the piston 130 and the handle 190.

The piston 130 divides the internal chamber 42 of the body 40 into a first or upper portion 150 and a second or lower portion 152. See FIG. 3B. Mounted within the opening 58 of the body 40 is the inlet or check valve 160. One or more openings 59 are provided in the annular overhanging lip 56 under the check valve 160. The check valve 160 permits the flow of fluid through the one or more openings 59 into the lower portion 152 while preventing the flow of fluid out of the internal chamber 42 through the one or more openings 59. A lower nipple 166 secures the check valve 160 in place.

With continued reference to FIGS. 3A and 3B, a biasing member 180, such as a helical spring, has a first or upper end 182, which is seated in an outer annular spring groove 88 formed in the cap 72. A second or lower end 184 of the biasing member is seated on the top of 134 of the piston 130.

With particular reference to FIGS. 2 and 3A, the handle 190 is mounted on the upper end 112 of the shaft 110. The handle includes a vertical stem 192 and a grip or horizontal portion 194. The horizontal portion 194 is desirably integrally formed with an upper end 196 of the stem 192. In the illustrated embodiment, the lower end 198 of the stem is press-fitted into the upper end 112 of the shaft 110 and secured by the engagement of an annular ridge 111 formed on the lower end 198 of stem 192 with an annular opening 113 formed on the upper end 112 of the shaft 110. In modified embodiments, other configurations may be used to connect the shaft 110 to the handle 190. For example, the shaft 110 and handle 190 may be integrally formed into a single piece or connected by a threaded arrangement. As shown in FIG. 3A, an internal channel 200 desirably extends through the horizontal portion 194 and the stem 192 so as to be communication with the channel 122 defined by the piston shaft 120.

The tubing 222 defines a chemical flow path that is in fluid communication with the lower portion 152 of the internal chamber 42. Advantageously, the tubing 222 extends continuously through the handle 190 and is coupled to the piston 130. In the illustrated embodiment (see FIG. 3B), the piston 130 includes an inner bore 252, which extends from the upper surface 134 to the lower surface 136. The distal end of the tubing 222 extends into the inner bore 252 and is press-fitted onto a plug 254, which also includes an inner bore 253. The plug 254 extends through the bore 252 and includes an radial flange 256, which contacts the lower surface 136 of the piston 130. In this manner, the tubing 222 is securely coupled to the piston 130 and the tubing 222 is prevented from being pulled out of the container 20 through the handle 190. The plug 254 may include series of annular ridges for securely retaining the surrounding tubing 222 in place. The tubing 222 is placed in fluid communication with the lower portion 152 of the internal chamber 42 through the inner bore 253 of the plug 254. Those of skill in the art will recognize that in modified embodiments other configurations may be used for placing the tubing 222 in fluid communication with the lower portion 154 of the internal chamber 42 and/or coupling the tubing 222 to the piston 130. For example, in one embodiment, the distal end of the tubing 222 may be press-fitted into the inner bore 252 piston and further secured by adhesives and/or annular ridges provided on the bore 252. In such an embodiment, the plug 254 may be eliminated. In other embodiments, the connection between the piston 130 and the tubing 222 may be made at or near the upper surface 134 of the piston.

Figure 5:
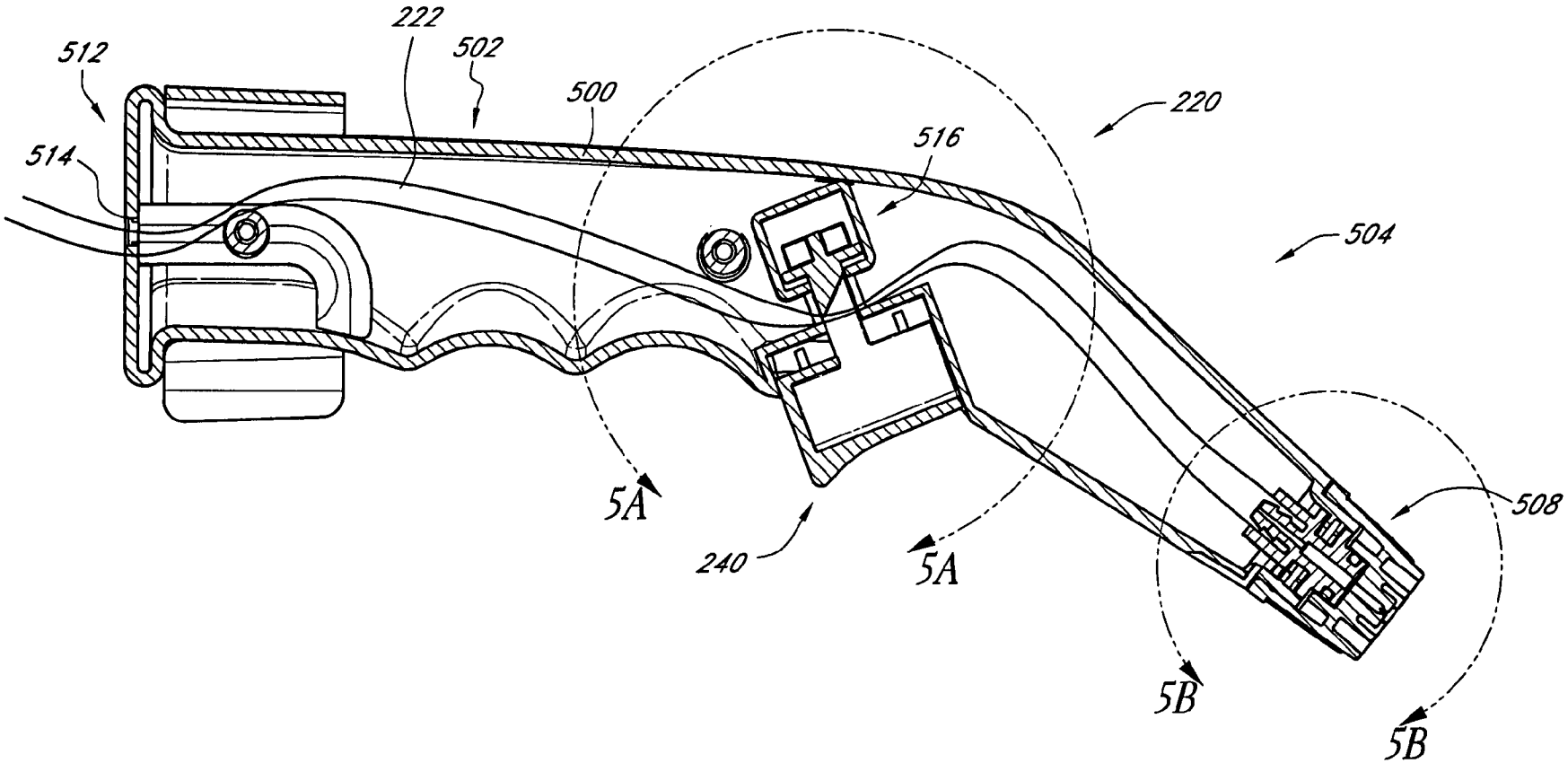
FIG. 5 is a cross-sectional view of a spray nozzle taken along line 5-5 of FIG. 2.

With reference now to FIGS. 2 and 5, the wand or spray nozzle 220 will now be described in detail. The spray nozzle 220 includes a body or housing 500, which defines a generally cylindrical grip portion 502, and a discharge end portion 504 that curves away from the cylindrical grip portion 502. The body 500 is advantageously configured such that spray nozzle 220 can be held in one hand by a user. A discharge nozzle 508 (see also FIG. 5B) is coupled to the distal end of the spray nozzle 220 and defines an internal channel 509, which terminates at a discharge outlet 510 through which the chemical is discharged from the spray nozzle 220.

In the illustrated embodiment, the proximal end 512 of the body 500 includes an inlet opening 514 for receiving the tubing 222. The tubing 222 advantageously continuously extends through the body 500 and through a valve 516, which will be described in more detail below. The valve 516 is controlled by the actuator 240, which is located on the underside of the spray nozzle 220.

The tubing 222 advantageously also extends continuously from the valve 516 to the discharge nozzle 508. As seen in FIG. 5B, In the illustrated embodiment, the discharge nozzle 508 is formed by a first piece 518 that defines the portion of the internal channel 509 which forms the discharge outlet 510. The first piece 518 may be coupled to the body 500 in a variety of arrangements. In the illustrated embodiment, the body includes a annular notch 519 which the first piece 518 engages in a snap fit. In a modified embodiment, the first piece is threaded onto the body 500. The discharge nozzle 508 also includes an inner member 520, which defines the portion 511 of the internal channel 509 that is in fluid communication with the tubing 222. In the illustrated embodiment, the inner member 520 includes a stem 521 that may be press-fitted into the tubing 222 so as to place the tubing in fluid communication with the internal channel 509 and the discharge outlet 510. Desirably, the stem 521 has a series of annular ridges for securely retaining the surrounding tubing 222 in place. The inner member 520 advantageously holds the tubing 222 in place and prevents it from being inadvertently withdrawn from the nozzle 220. Those of skill in the art will recognize that in other embodiments different configuration may be used to connect to couple the tubing 222 to the discharge nozzle 508 and/or place the tubing in fluid communication with the discharge outlet 510. For example, in one modified arrangement, the tubing 222 can be press-fitted into a bore formed in the inner member 520 and further secured via adhesives or annular ridges.

With continued reference to FIG. 5B, the portions of the internal channel 509 in the first piece 518 and the inner member 520 may be connected in a variety of manners. In the illustrated embodiment, the inner member 520 includes a plug 527 that can be inserted into a recess 523 formed in the first piece 518. An O-ring 524 may be placed between the plug 527 and the recess 523 so as to seal the connection. In modified embodiments, the discharge nozzle may be formed from a single piece or more than two pieces. In other embodiments, the tubing 222 may extend through the discharge nozzle 508 and form, at least partially, the discharge outlet 510.

In the illustrated embodiment, the tubing 222 is coupled to the piston 130 and the discharge nozzle 508 and extends continuously between these two components. In modified embodiments, the tubing 222 may be coupled to the piston 130 and extend continuously through the handle 190 and/or the tubing 222 may extend continuously from the inlet opening 514 of the spray nozzle 220 through the valve 516 and be coupled to the discharge nozzle 508 and/or extend to the discharge outlet 510. In yet another embodiment, the tubing 222 may extend continuously from a point upstream of the valve 516 to a point downstream of the valve 516. In still yet another embodiment, the tubing 222 is coupled to the piston and extends continuously to spray nozzle 220. These embodiments and various combination and sub-combinations thereof advantageously reduce the number of sealing components (e.g., O-rings and sealing members) required to manufacture the attachment 30. Similarly, it can reduce tolerance issues, which would otherwise be involved in linking a series of mating components. In this manner, these embodiments may dramatically reduce the costs of manufacturing and assembly the attachment 30. In the embodiments, in which the tubing 222 is divided into two or more portions, the portions can be connected via plugs with internal bores or a combination of O-rings and other components (e.g., fittings) as will be apparent to those of skill in the art.

The valve 516 will now be described in detail with reference to FIG. 5A and FIGS. 6A-D. The actuator 240 positioned at least partially within a housing 530, which, in the illustrated embodiment, is formed in the body 500. The illustrated actuator 240 comprises a horizontal base member 239, a pair of side walls 241*a*, 241*b* and a front wall 241*c*. The actuator 240 is coupled to a stem 532 which is formed from a pair spaced a part leg members 533*a*, 533*b* which extend from the side walls 241*a*, 241*b* of the actuator 240. A pinching member 534 is positioned between the leg members 533*a*, 533*b*. As seen in FIG. 6D, the pinching member 534 defines a slanted pinching surface 535. The leg members 533*a*, 533*b*, the pinching surface 535 and the actuator 240 define an opening 537 (see FIG. 6B). A distal stop 539 is attached to the distal end of the leg members 533*a*, 533*b*. Advantageously, the distal stop 539 has a cross-sectional diameter that is larger than the cross-sectional diameter of the leg members 533*a*, 533*b*. A spacing support 541 extends distally from the distal stop 539. In the illustrated embodiment, the spacing support 541, comprises a pair of support members arranged perpendicularly to each other.

Figure 5A:
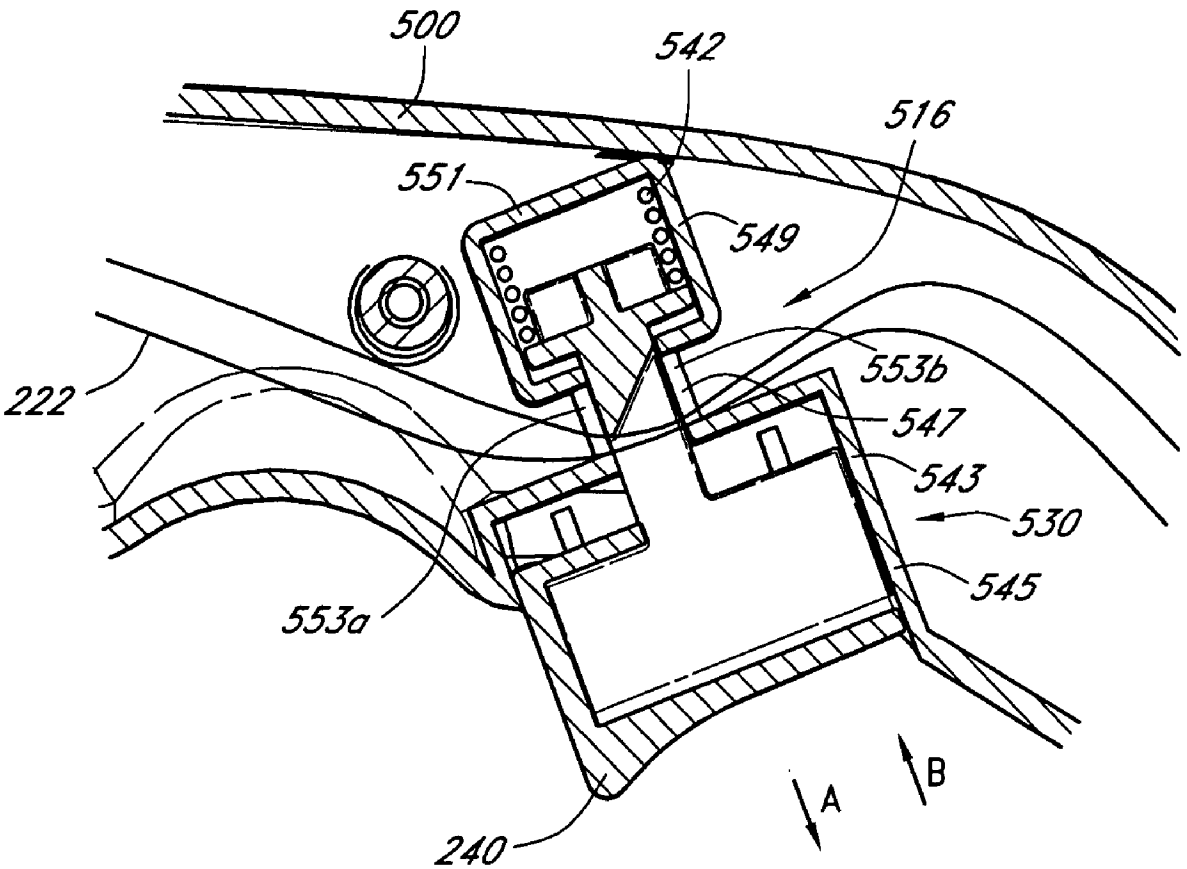
FIG. 5A is an enlarged view of the central portion of the spray nozzle of FIG. 5.
Figure 5B:
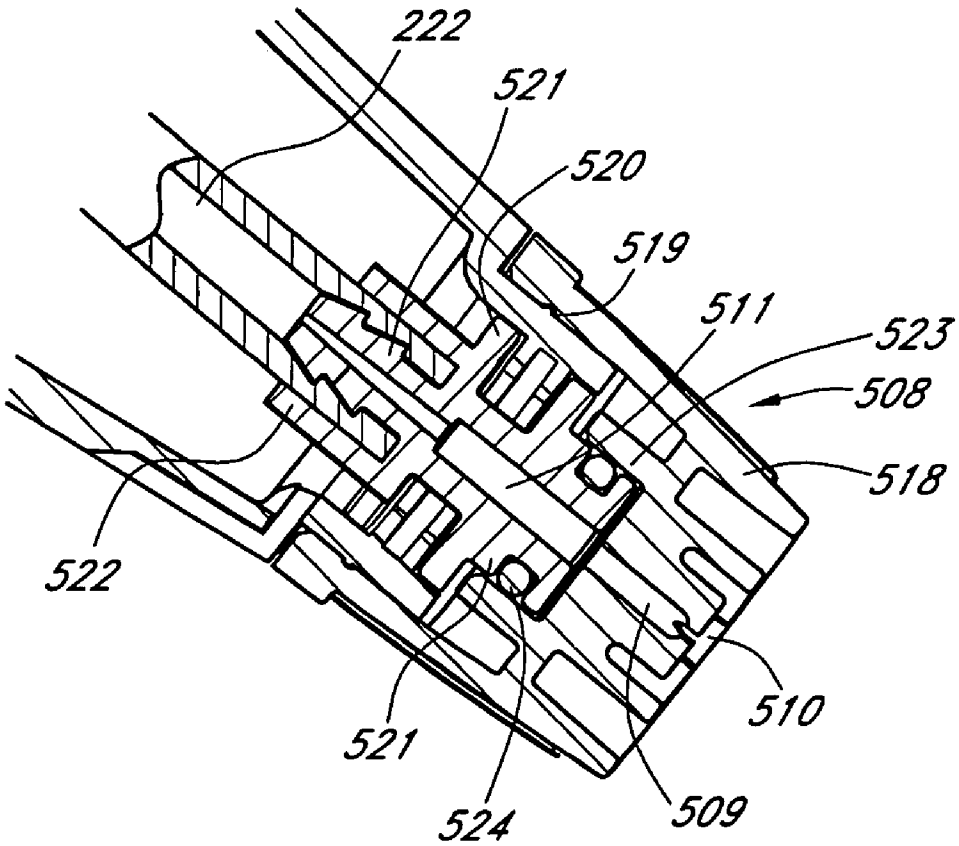
FIG. 5B is an enlarged view of the tip of the spray nozzle of FIG. 5.
Figure 6A:
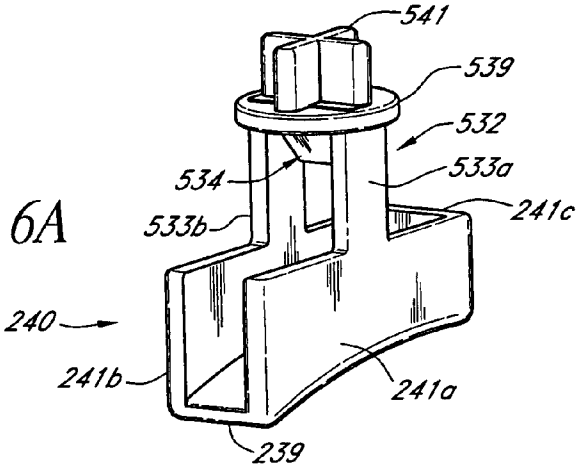
FIG. 6A is a top perspective of an actuator of the spray nozzle.
Figure 6D:
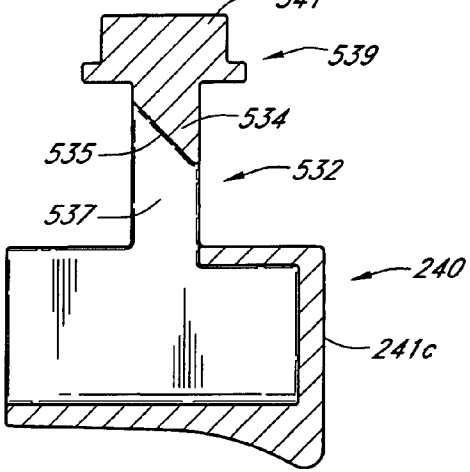
FIG. 6D is a cross-sectional view of the actuator of FIG. 6A taken along line 6D-6D.
Figure 6C:
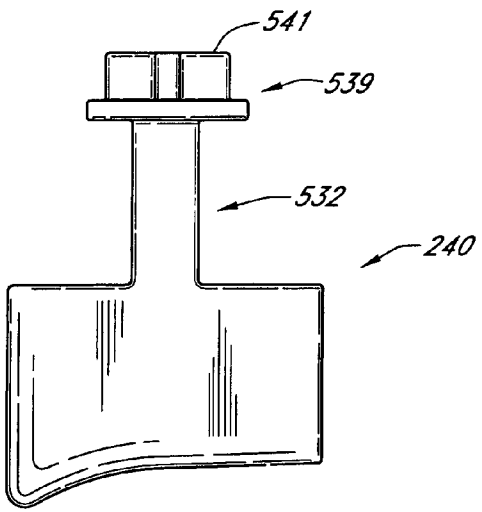
FIG. 6C is a side view of the actuator of FIG. 6A.
Figure 6B:
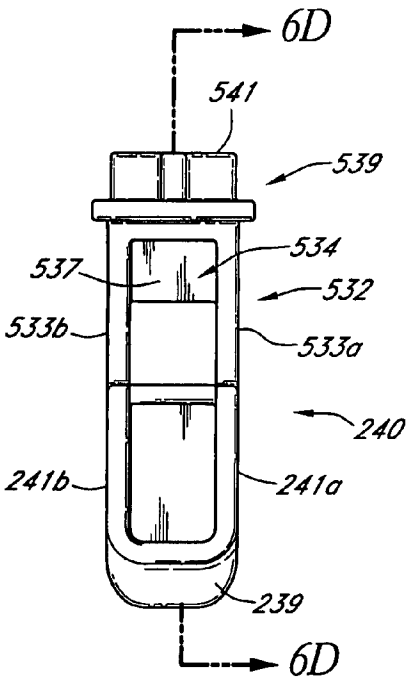
FIG. 6B is a front view of the actuator of FIG. 6A.

With reference to FIG. 5A, the housing 530 generally comprises side wall 543, which defines a first bore 545, a second bore 547, and a third bore 549. In the illustrated embodiment, the first bore 545 has a diameter that is larger than the third bore 549, which has a diameter larger than the second bore 547. The third bore 549 is closed at a distal end by a horizontal member 551. When the actuator 240 is positioned within the housing 530, the opening 537 is positioned at least partially within a second bore 547. The distal stop 539, in turn, is positioned within the third bore 549 and the actuator 240 is positioned in the first bore 545. The second bore 547 includes a pair of passages 553*a*, 553*b*, which form openings on opposite sides of the second bore 547.

With continued reference to FIG. 5A, the tubing 222 extends through the passages 553*a*, 553*b* in the second bore 547 and through the opening 537 between the leg members 533*a*, 533*b* and the pinching member 534. A biasing member 542, such as a helical spring, is placed within the third bore 549 between the distal stop 539 and the horizontal member 551. In this manner, the biasing member 542 biases the actuator 240 in the direction of arrow A of FIG. 5A. The actuator 240 his held in place by the distal stop 539, which cannot move into the second bore 547. In this first position, which is illustrated in FIG. 5A, the tubing 222 is compressed between the pinching surface 534 and the passage 553*a* in the second bore 547. As such, the tubing 222 is "pinched closed" and chemical cannot flow though the tubing 222 and the valve 516. The spray nozzle 220 is therefore closed and the chemicals from the container cannot flow to the discharge outlet 510. To open the spray nozzle 220, the user depresses the actuator 240 in the direction of arrow B of FIG. 5A against the force of the biasing member 542. In this manner, the tubing 222, which extends through the second bore 547 is no longer "pinched" between the pinching surface 534 and the passage 553*a*. Thus, chemicals can flow through the valve 516 to the discharge nozzle 508. Of course, those of skill in the art will recognize that in modified embodiments other configurations may be used for "pinching close" the tubing 222 in the spray nozzle 220. In addition, in embodiments in which the tubing 222 does not extend through the valve 516 other types of valves can be used such as the valves disclosed in U.S. Pat. No. 5,918,782, which is hereby incorporated by reference herein.

The tubing 222 in the illustrated embodiment generally comprises a tubular wall member 223, which defines a chemical path 225 through which chemicals from the container can flow. Advantageously, the tubing 222 may be made of a flexible, light weight material with substantially uniform properties throughout the length of tubing 222 used in the attachment 30.

With to reference back to FIGS. 1 and 2, the illustrated attachment advantageously includes a holder 550 for holding the sprayer nozzle 220 during storage or shipment. In the illustrated arrangement, one end of the holder 550 is mounted between the container 20 and the coupler 70. The other end of the holder 550 comprises a cylindrical body 552 through which the nozzle 220 can be inserted. As shown in FIG. 1, the proximal end of the nozzle 220 advantageously includes an protrusion or enlarged portion 554, which prevents the nozzle 220 from falling through the cylindrical body 552.

Figure 7:
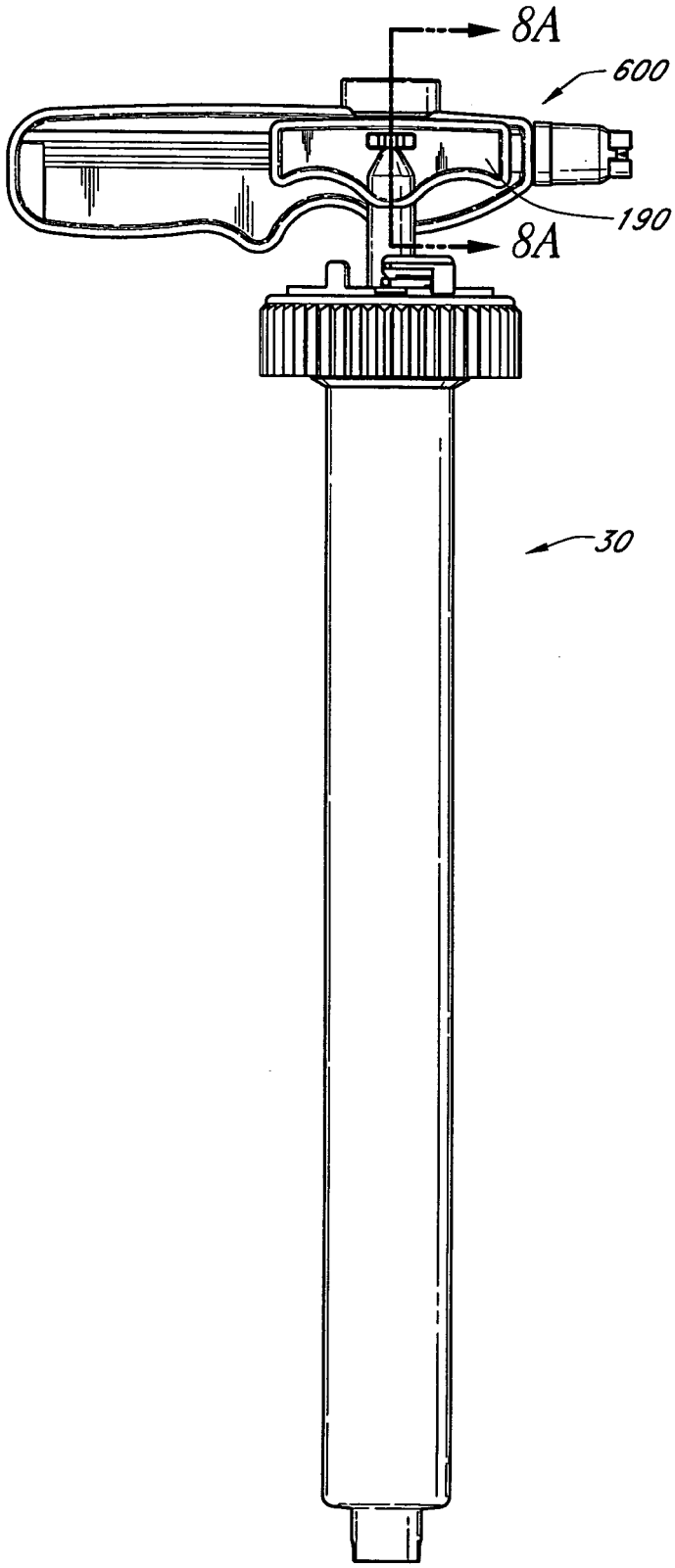
FIG. 7 is a cross-sectional view of another example embodiment of a pump apparatus.
Figure 8A:
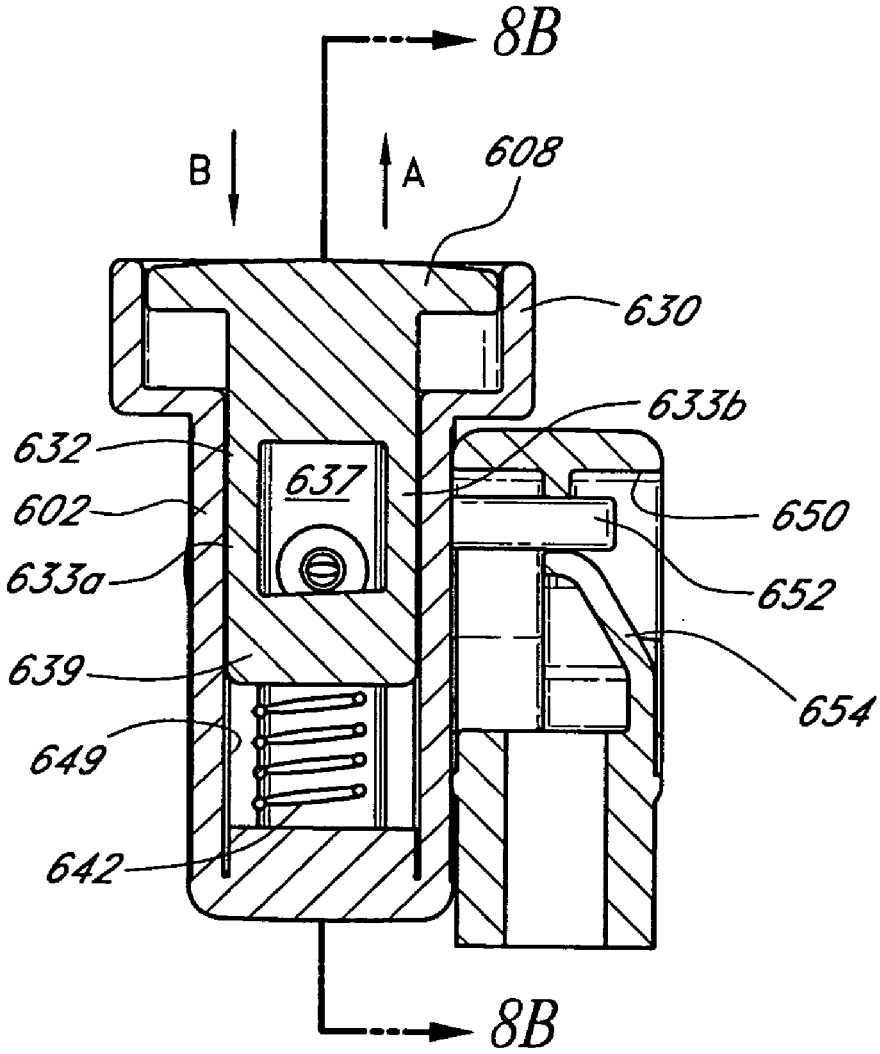
FIG. 8A is a cross-sectional view taken through line 8A-8A of FIG. 7.
Figure 8B:
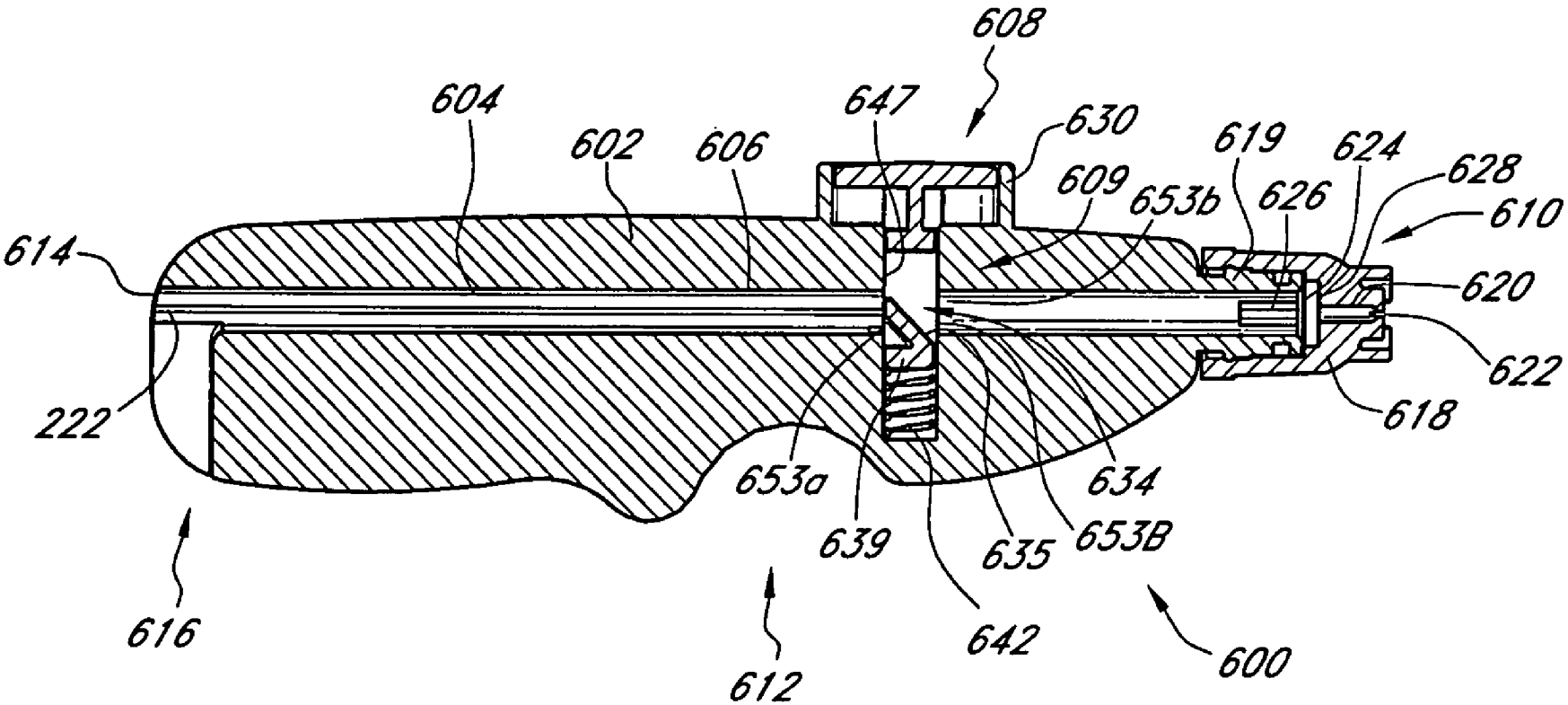
FIG. 8B is a cross-sectional view taken through line 8B-8B of FIG. 8A.

FIGS. 7-8B illustrated a modified embodiment of a spray nozzle 600. In this embodiment, the sprayer 600 comprises a body 602, which includes an internal pathway 604 defined by a channel 606, an actuator 608 for controlling a release valve 609 and a discharge nozzle 610. The body 602 advantageously configured such that sprayer 600 can be held in one hand by a user. In the illustrated embodiment, the body 602 defines a recess 612 for the index finger of the user. In the illustrated embodiment, the channel 606 defines a first opening 614 at a proximal end 616 of the body for receiving the tubing 222. In the illustrated embodiment, the tubing 222 advantageously extends continuously through the spray nozzle 600, past the actuator 608 and is coupled to and in fluid communication with the discharge nozzle 610. In the illustrated embodiment, the discharge nozzle 610 includes a plug 624, which is mounted between the discharge nozzle and the body 602 and extends partially into the internal channel 604. The tubing 222 is mounted over the plug 624, which includes an internal channel or bore 626 and may include annular retention structures as described above. As mentioned above, those of skill in the art will recognize that in other embodiments different configurations may be used to connect to couple the tubing 222 to the discharge nozzle 610 and/or placing the tubing 222 in fluid communication with the discharge outlet 222 In modified embodiments, the discharge nozzle 610 may be formed from more or less pieces. In addition, the tubing 222 may extend through the discharge nozzle 610 and form, at least partially, the discharge outlet 622.

The valve 609 will now be described in detail. The actuator 608 positioned at least partially within an annular housing 630, which, in the illustrated embodiment, extends from the body 602. The actuator 608 is coupled to a stem 632, which is formed from a pair spaced a part leg members 633*a*, 633*b* that extend from the actuator 608. A pinching member 634 is positioned between the leg members 633*a*, 633*b*. As seen in FIG. 8B, the pinching member 634 defines a slanted pinching surface 635. The leg members 633*a*, 633*b*, the pinching surface 635 and a lower surface of the actuator 608 define an opening 637 (see FIG. 8A). A distal support 639 is attached to the distal end of the leg members 633*a*, 633*b*. The tubing 222 prevents the actuator 608 from being removed from the body 602.

With particular reference to FIGS. 8A and 8B, the body 602 forms a bore 649 that includes a pair of passages 653*a*, 653*b*, which form openings on opposite sides of the bore 649. The tubing 222 extends through the passages 653*a*, 653*b* in the bore 647 and through the opening 637 between the leg members 633*a*, 633*b* and the pinching member 634. A biasing member 642, such as a helical spring, is placed within the bore 649 between the distal stop 639 and a lower surface of 643 of the bore 649. In this manner, the biasing member 642 biases the actuator 608 in the direction of arrow A of FIG. 8A. In this first position, the tubing 222 is compressed between the pinching surface 634 and the passage 653*a* in the second bore 649. As such, as with the previous embodiment, the tubing 222 is "pinched closed" and chemical cannot flow though the tubing 222 and the valve 609. To open the spray nozzle 600, the user depresses the actuator 608 in the direction of arrow B of FIG. 8A against the force of the biasing member 642. In this manner, the tubing 222, which extends through the bore 649 is no longer "pinched" between the pinching surface 634 and the passage 653*a*. Thus, chemicals can flow through the valve 609 to the discharge nozzle 610. Of course, those of skill in the art will recognize that in modified embodiments other configurations may be used for "pinching close" the tubing 222 or that other types of valves can be used such as the valves disclosed in U.S. Pat. No. 5,918,782, which is hereby incorporated by reference herein.

With reference to FIGS. 7 and 8A, the spray nozzle 600 is advantageously configured such that it can be detachably coupled to the handle 190 of the pump attachment 30. In the illustrated embodiment, this is accomplished by providing the handle 190 with an opening 650, which in the illustrated embodiment is rectangular. The spray nozzle 600, in turn, includes plurality of projections 652, which is configured so as to engage a flexible arm 654 positioned in the opening 650. In this manner, the spray nozzle 600 can engage the handle 190 in a snap fit. In modified embodiments, the spray nozzle 600 include a groove or protrusion while the handle 190 includes complementary a protrusion or groove. Those of skill in the art in light of this specification will also recognize other complementary structures which can be use for detachably coupling the spray nozzle 600 to the handle 190.

Figure 9:
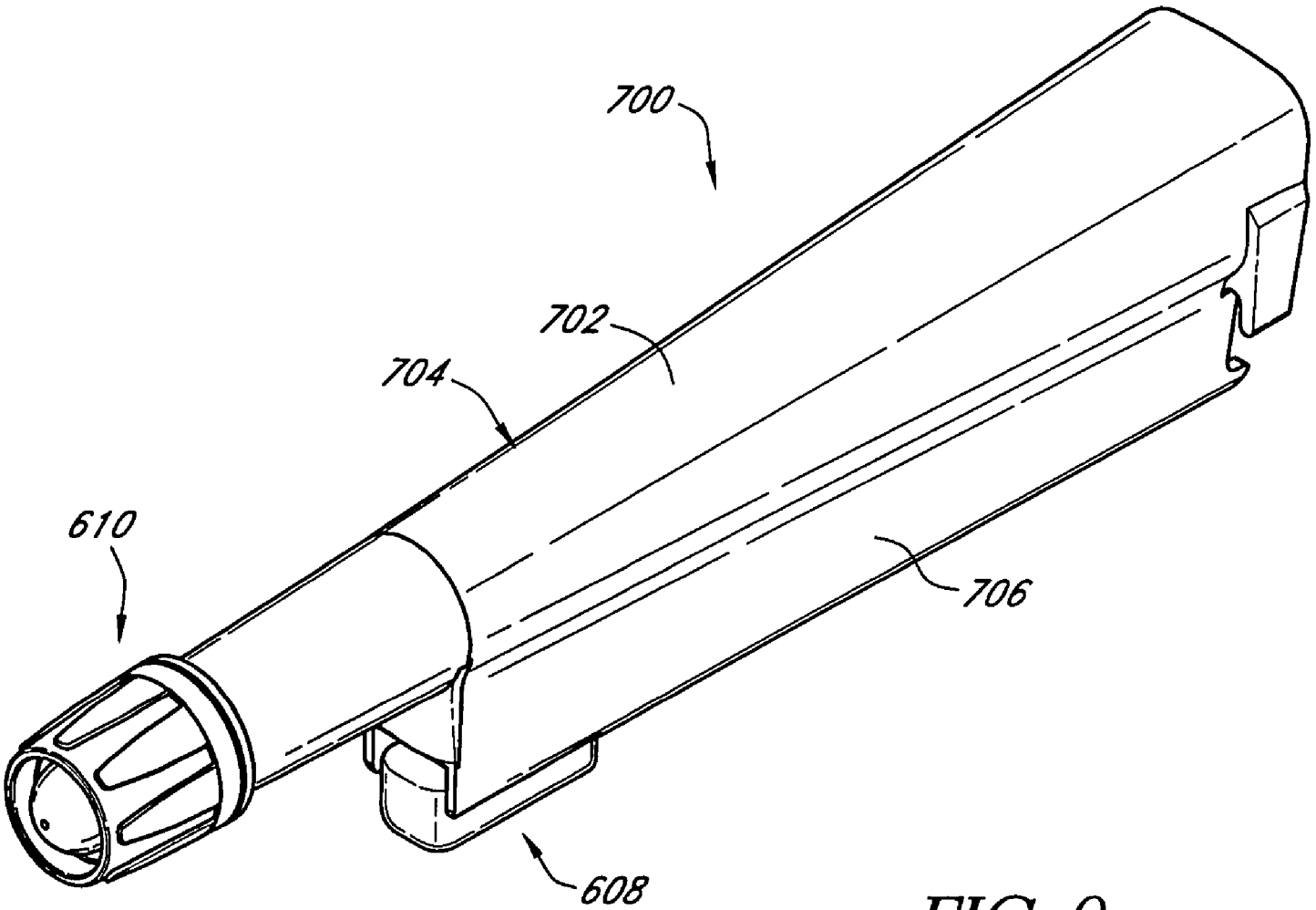
FIG. 9 is a top perspective view of an example embodiment of a spray nozzle.
Figure 10:
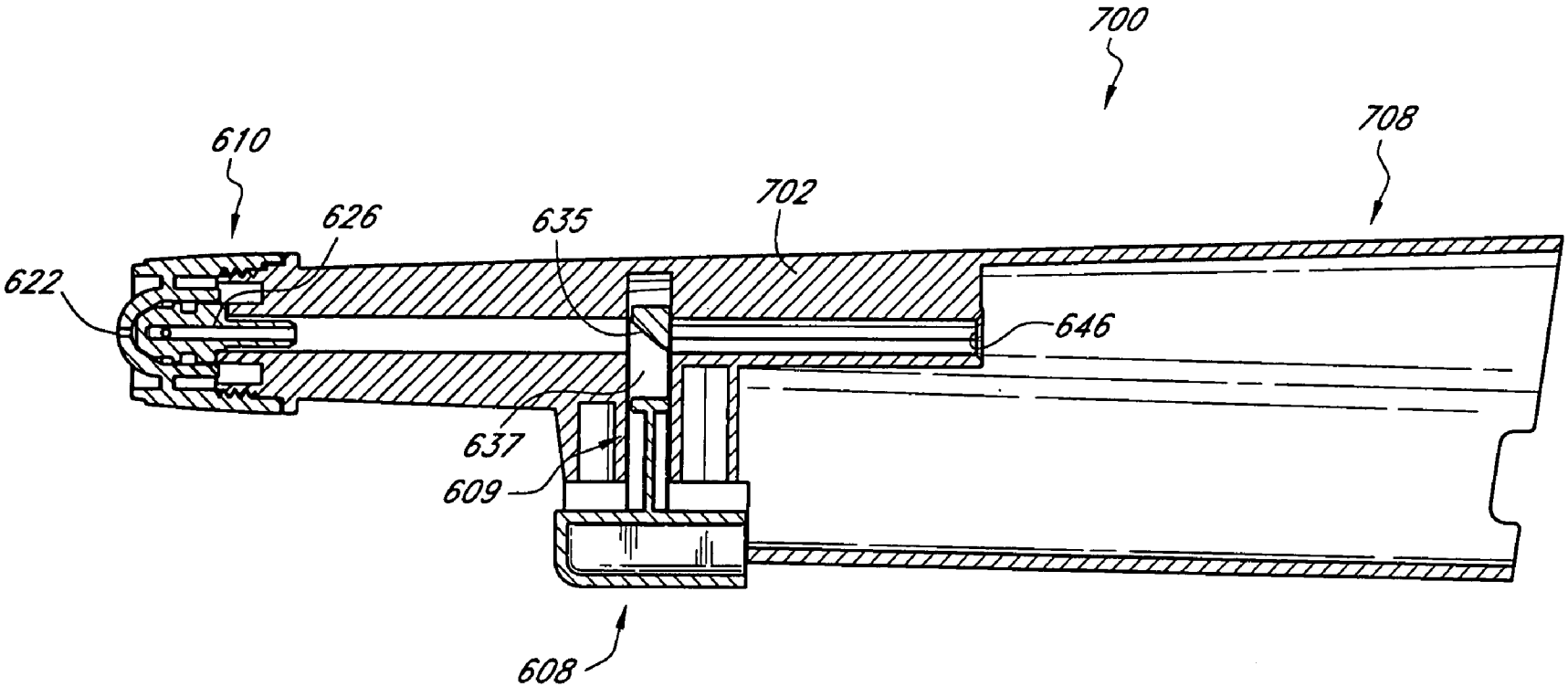
FIG. 10 is a longitudinal cross-sectional view of the spray nozzle of FIG. 9.

FIGS. 9 and 10 illustrate another exemplary embodiment of a spray nozzle 700 shown without the tubing 222. In this embodiment, components that are similar to the components of the previous embodiment have been given the same reference number. As shown in FIGS. 9 and 10, the main difference between this embodiment and the previous embodiment is the shape of the body 702 and the position of the actuator 608. The actuator 608 is positioned on the underside of the body 702. In addition, the body 702 comprises a conical main section 704 and rectangular lower portion 706, which extend beneath the conical main section. As shown in FIG. 10, the inlet opening to the internal channel is protected by a proximal portion 708 of the body 702 which extend proximally from the inlet opening 646.

Figure 11:
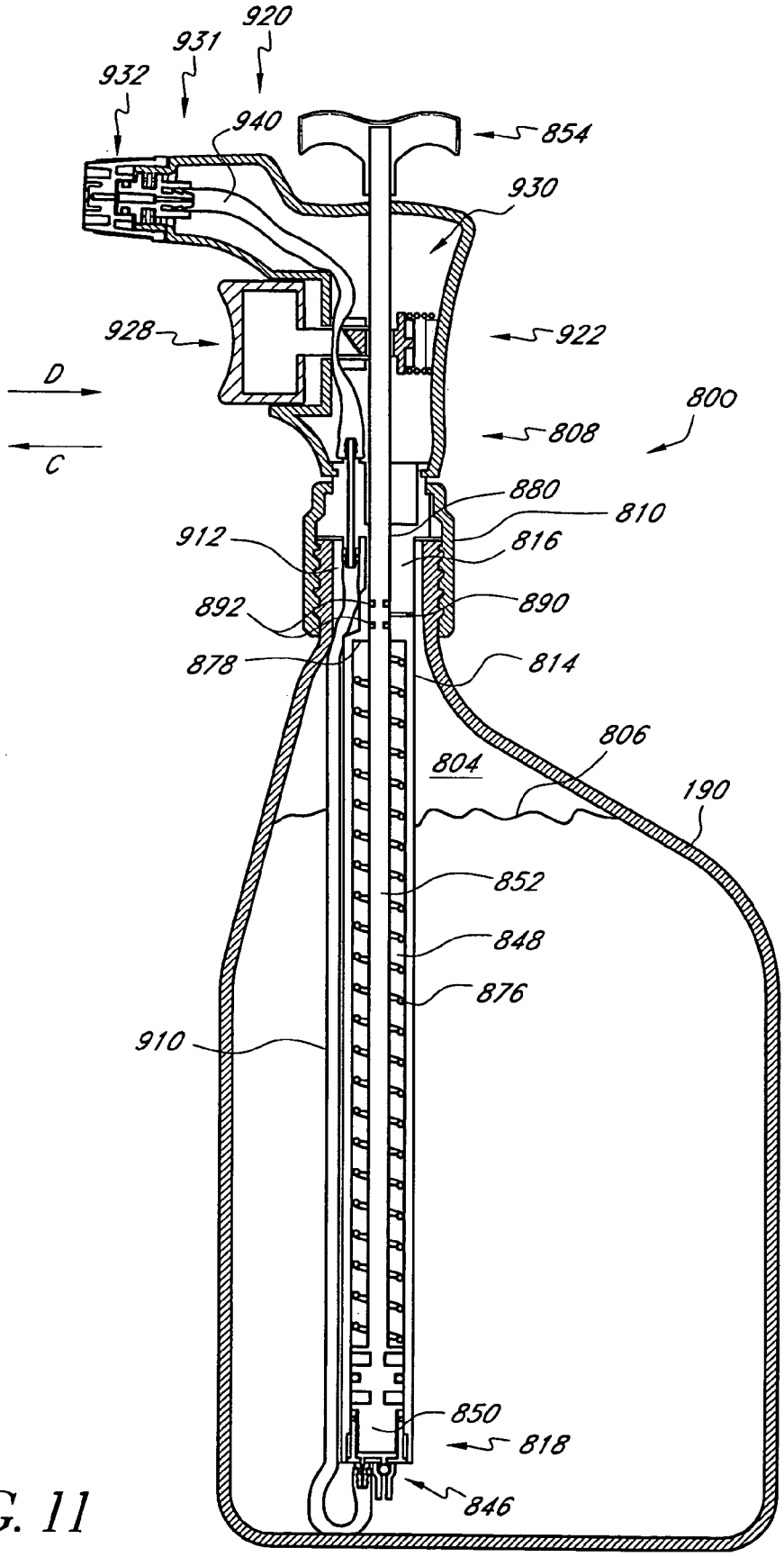
FIG. 11 is a cross-sectional side view of a modified embodiment of a spray nozzle and pump assembly.
Figure 11A:
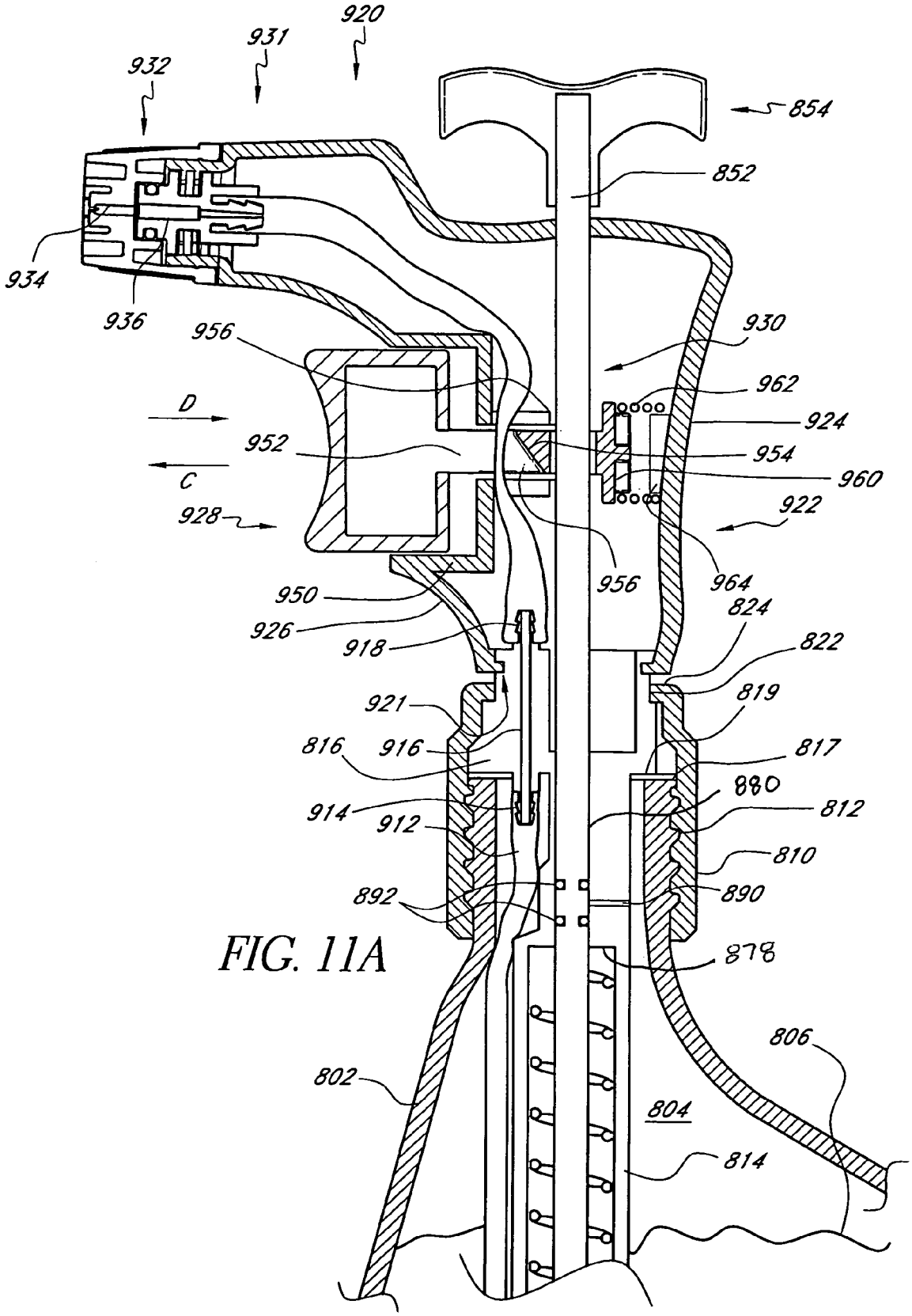
FIG. 11A is a closer view of a top portion of the spray nozzle and pump assembly of FIG. 11.
Figure 11B:
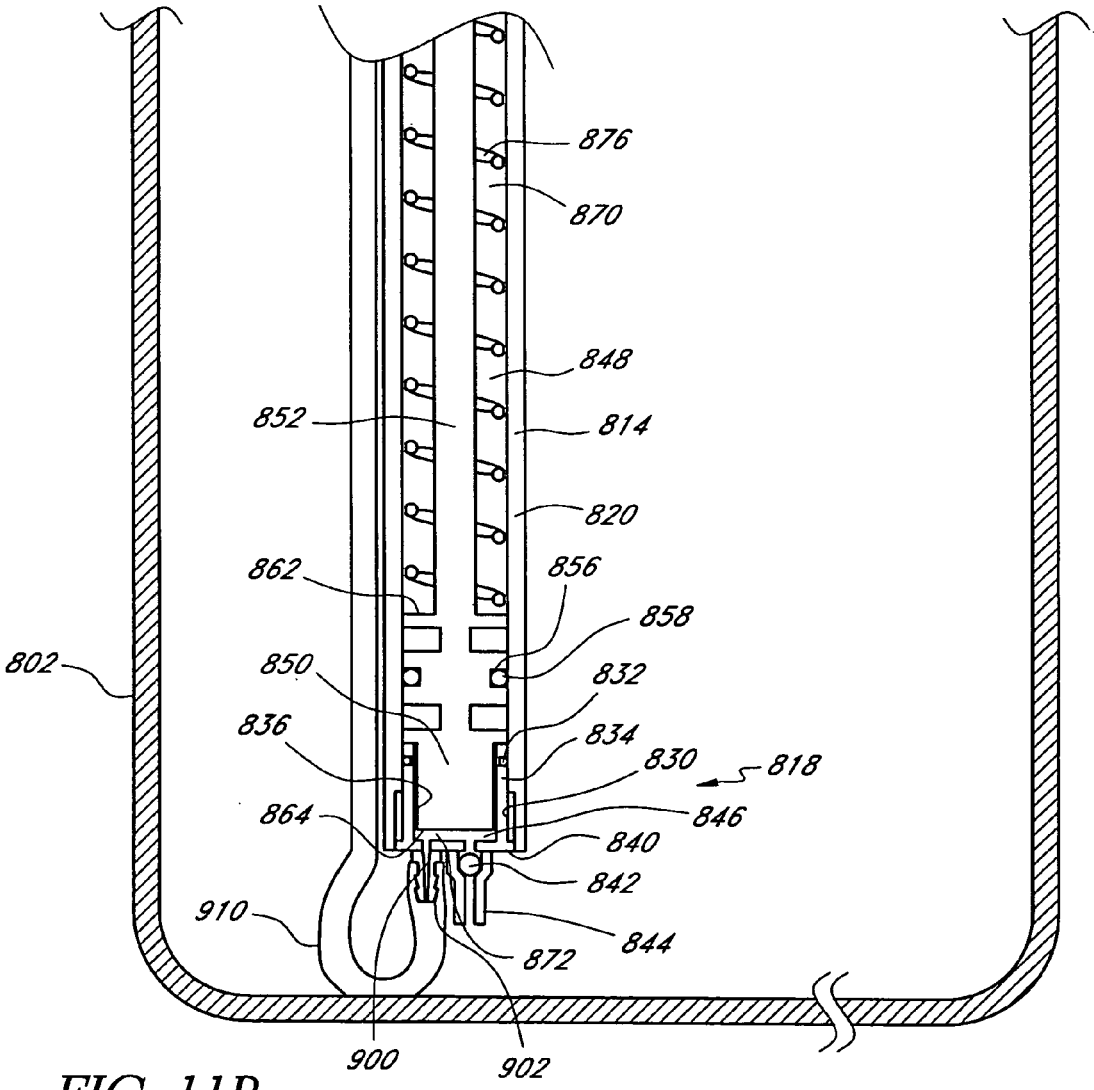
FIG. 11B is a closer view of a bottom portion of the spray nozzle and pump assembly of FIG. 11.

FIG. 11 is a cross-sectional side view of another exemplary embodiment of a sprayer 800. FIGS. 11A and 11B are closer views of the upper and lower portions of the sprayer 800.

The device comprises a container 802, which defines an internal space or reservoir 804 for storing a chemical 806. A pump attachment 808 is coupled to the container 802. In the illustrated embodiment, the pump attachment 808 includes an attachment nut 810, which is detachably coupled to the container 802 by corresponding threads 812 provided on the open neck of the bottle and the nut 810. As shown in FIG. 11A, a gasket 817 is preferably provided between the neck of the bottle 802 and the a lower sealing surface 819 of the attachment 808.

With reference to FIG. 11A, The pump attachment 808 includes a body or piston chamber 814 that extends into the container 802. The illustrated body 814 comprises a cylinder that includes a first or upper end 816, a second or lower end 818, and a side wall 820. The upper end 816 extends through the nut 810 and includes an annular groove 822, which is configured to engage an inwardly extending annular flange 824 of the nut 810.

With reference to FIG. 11B, the lower end 818 includes an end cap 830, which is inserted into the piston chamber 814. A sealing member 832 (e.g., an O-ring) may be provided for providing a seal between the end cap 830 and the body 814. The end cap 830 closes the lower end of the piston chamber 814. The end cap 830 includes an annular wall 834, which extends into the chamber 814 and includes an annular groove for a sealing member 832. The annular wall 834 defines an inner wall 836. The end cap 830 also includes an annular overhanging lip 840, which defines an opening 842 and a depending flange 844 extending downward from the annular lip 840 surrounding the opening 842. Mounted within the opening 842 is an inlet or check valve 846, which in the illustrated embodiment is in the form of a ball valve. The check valve 846 permits the flow of fluid through the opening 842 into the body 814. In modified embodiments, the check valve may be another type of valve, such as, for example, an umbrella or flapper valve positioned within a corresponding recess.

The body 814 defines an internal chamber 848, in which a piston 850 is positioned. In the illustrated embodiment, the piston 850 integrally formed with or connected to a shaft or piston rod 852. A handle 854 is mounted on, coupled to or integrally formed with the shaft 852. In the illustrated embodiment, the lower end of the shaft 852 advantageously defines the piston 850. However, in modified embodiments, the piston 850 may be coupled to the shaft 852.

In the illustrated embodiment, the piston 850 includes a recess 856 for receiving a sealing member 858 (e.g., an O-ring). The piston 850 includes a body having a top 862 and bottom 864. The bottom 864 has a first portion that is configured to extend and fit within the inner wall 836 of the end cap 830 and a second portion that rests against the top surface of the annular wall 834.

In a modified embodiment, the shaft 852 may be formed from one or more elongated members that couple the handle 854 to the piston 850. In addition, the bottom 864 of the piston 850 may have a different shape. However, the illustrated shape is preferred because it maximizes displacement of fluid in the piston chamber 848. It is also anticipated that in some embodiments the shaft 852 may be formed from a non-rigid or flexible member.

With continued reference to FIG. 11B, the piston 850 divides the piston chamber 848 of the body 814 into a first or upper portion 870 and a second or lower portion 872, which is located, in part, between the bottom 864 of the piston and the body 814.

As shown in FIG. 11, a biasing member 876, such as a helical spring, has a first or upper end, which is seated against a surface 878 formed in the body 814. A second or lower end of the biasing member 876 is seated on the top of the piston 850.

The shaft 852 extends through an opening 880 formed in the upper end of the body 814. In this manner, the handle 854 extends above the pump attachment 808. The user may grab the handle 854 and pull on the piston 850 to compress the spring 876. As the piston 850 is moved upward, fluid is drawn through the check valve 846 and into the second portion 872 of the piston chamber 848. A vent hole 890 (see also FIG. 11A) is provided in the body 814 near the nut 810 to allow air to enter and exit the upper portion 870 as the piston 850 is moved. Sealing members 892 (e.g., O-rings) are provided on the shaft 852 to provide a seal between the shaft 852 and the vent hole 890 when the handle 854 is in the pull down position. The body 814 may include a bleed valve (not shown) for allowing the slow discharge of fluid in the second portion 872 back into the container.

Once the piston 850 is raised, the fluid in the lower portion 872 is pressurized by the downwardly directed force of the piston 850 created by the spring 876. Fluid is prevented from exiting through the opening 842 by the check valve 846. As such, the fluid in the piston chamber 848 is directed through an opening 900 (see FIG. 11A) formed in the end cap 830. The opening 900, in turn, may be placed in communication with a tubing 910 through a barbed fitting 902, which includes an internal channel. The tubing 910 may be fitted over the barbed fitting 902 to place the tubing 910 in fluid communication with the piston chamber 948 through the opening 900. Of course in modified embodiments, other arrangements may be provided for coupling the tubing 910 to the end cap 830. For example, the tubing 920 may be press fitted into a corresponding hole and/or secured via adhesives and/or one or more fasteners.

The tubing 910 has a second end 912 (see FIG. 11A), which may be coupled to a second fitting 914 provided in the upper end of the body 814 within the attachment nut 810. The fitting 914, in turn, defines, in part, an internal channel 916, which is in fluid communication with the interior of the tubing 910. In the illustrated embodiment, the fitting 914 is barbed to secure the tubing 910; however as mentioned above, other arrangements may be used to secure the second end 912 to the body 814. The internal channel 916 terminates at a third fitting 918, which may also include barbs or other attachment arrangements.

With reference to FIG. 11A, the pump attachment 800 includes a spray nozzle housing 920. In the illustrated embodiment, the housing 920 is attached to the upper end of the body 814, which extends above the nut 810. Various methods may be used to couple the housing 920 to the body 814. In the illustrated embodiment, the housing 920 and the body 814 are provided with corresponding annular flanges and grooves 921. The housing 920 is preferably formed in two halves, which may be suitable attached to each other through a snap fitting, one or more fasteners, and/or an adhesive to secure the housing 920 together around the body 814.

The illustrated housing 920 defines a first portion 922, which extends in a generally vertical direction from the body 814. The first portion 922 defines a rear surface 924 and a front surface 926. A trigger 928 for a valve 930, which will be described in more detail below, extends from the front surface 926. In one embodiment, the first portion 922 is configured such that the user can grip the first portion 922 with one hand with the users palm resting against the rear surface 924 while the fingers wrap around to the front portion 926. The trigger 928 may then be activated by compressing the trigger 928 between one or more fingers (e.g., the index finger) and the palm of the user's hand.

The housing 920 also defines a second portion 931, which lies generally above the first portion 922 and extends generally in a horizontal direction away from the rear surface 924 of the first portion 922. Mounted preferably on the distal most end of the horizontal portion 931 is a spray nozzle 932. In one embodiment, the spray nozzle 932 may be coupled to the horizontal portion 931 by a snap fitting formed between corresponding grooves and ribs between positioned on the nozzle 932 and horizontal portion 931. In other embodiments, corresponding threads on the exterior of the housing 920 and the interior of the spray nozzle 932 may be used. The spray nozzle 932 defines an outlet channel 934, which may be placed in communication with a fitting 936 (e.g. a barbed fitting) which has one end that is inserted into the spray nozzle 932. The second end of the fitting 936 is attached to a second tubing 940, which has a second or opposite end that is attached to the fitting 918 on the body 814. In this manner, the spray nozzle 936 is placed in fluid communication with the piston chamber 848 through the first tubing 910, the second tubing 940 and the fittings and internal channels therebetween.

Flow through the second tubing 940 is controlled by the valve 930, which is shown schematically in FIG. 11A. The valve 930 may be a pinch valve that is configured in a manner similar to that described above. For example, the trigger 928 may be positioned at least partially within a valve housing 950 that may be formed in part by the sprayer housing 920. The trigger 928 may coupled to a stem 952 which is formed from a pair of spaced a part leg members, which extend from the side walls the stem 952. A pinching member 954 may be positioned between the leg members and may form a slanted pinching surface 956. The leg members, the pinching surface and the stem define an opening which in an open position is aligned with an opening 956 in the housing 950. The second tubing 940 extends through these openings. A distal stop 960 is attached to the distal end of the leg members. Advantageously, the distal stop 960 has a cross-sectional diameter that is larger than the cross-sectional diameter of the leg members so as to secure the trigger to the valve housing 950.

A biasing member 962, such as a helical spring, is placed between the distal stop 960 and a boss 964 formed on the internal of the nozzle 930. In this manner, the biasing member 962 biases the trigger 928 in the direction of arrow C of FIG. 11A.

As with the previous embodiments, the valve 930 is actuated between a first position, in which the tubing 940 is compressed between the pinching surface 956 and the opening in the housing 950, and a second position, in which the tubing no longer completely pinched closed. As such, to permit fluid to flow from the internal chamber 848 through the spray nozzle 934, the user depresses the trigger 928 in the direction of arrow D against the force of the biasing member 962. In this manner, the tubing 940 is no longer "pinched" between the pinching surface 956 and the opening in the housing 950. Thus, chemicals can flow through the valve 930 to the spray nozzle 934. Of course, those of skill in the art will recognize that in modified embodiments other configurations may be used for "pinching close" the tubing 940. In addition, in other embodiments, other types of valves can be used such as the valves disclosed in U.S. Pat. No. 5,918,782, which is hereby incorporated by reference herein.

In the illustrated embodiment, the axis of the piston shaft 852 extends generally through the center of the housing 920 and the attachment nut 810. In such an embodiment, the spray nozzle 930 and container 902 may be generally symmetrical with respect to the longitudinal axis of the shaft 852. It such embodiments it may be advantageous to position the trigger 928 such that it is also symmetrical with respect to the longitudinal axis of the shaft 852 as shown in FIGS. 11-11B. In the illustrated embodiment, the shaft 852 extend through the pair of spaced a part leg members of the stem 952. In other embodiments, the valve 930 and/or the shaft 852 may be offset from each other such that they do not interfere. For example, the trigger and the valve 930 may be simply be offset from the axis of the shaft 852. In still other embodiments, the axis of the shaft 852 may be offset from the center of the housing and the attachment nut.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combination or sub-combinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A pump attachment for a container comprising:

a body having a first end and a second end and defining a chamber formed in part by a interior wall extending between the first end and the second end;

a shaft extending into the chamber through an opening in the first end of the body;

a piston reciprocally mounted within the chamber and coupled to the shaft, the piston including an upper surface and a lower surface, the piston being in sealing engagement with the interior wall of the body, the piston separating the chamber into an upper portion above the upper surface of the piston and a lower portion below the lower surface of the piston;

a handle coupled to the piston through the shaft;

an inlet valve at the second end of the body, the inlet valve configured to permit the flow of fluid into the chamber and restrict the flow of fluid out of the chamber;

a biasing member within the chamber between the piston and the first end of the body, and an outlet passage at the second end of the body;

a conduit in fluid communication with the outlet passage;

a spray nozzle that comprises an actuator and a discharge outlet, the actuator being coupled to a spray valve for controlling the flow of chemical from the conduit through the spray nozzle to the discharge outlet, the spray nozzle being rigidly coupled to the container while the discharge outlet defines a spray pattern;

wherein the spray nozzle includes a flexible tube that is in fluid communication with the conduit and that extends continuously from a point upstream of the spray valve to a point downstream of the spray valve and wherein when the actuator is in a first position the tubing passes through the valve substantially unobstructed and in a second position the tubing is pinched closed within the valve.

2. A pump attachment for a container as in claim 1, wherein the spray patter has a generally horizontal direction with respect to the user of the pump.

3. A pump attachment for a container as in claim 1, wherein the spray nozzle is configured such that the user can grasp the spray nozzle with one hand while simultaneously rigidly supporting the bottle that is coupled to the pump attachment.

4. A pump attachment for a container as in claim 3, wherein the spray nozzle comprises a generally vertically extending support surface that extends in a generally vertical direction and the actuator includes a generally vertically extending actuating surface, the support surface configured to support the palm of the user's hand while the actuator surface supports a finger of the user hand, the actuator configured to be actuated by moving the finger towards the palm of the user's hand.

5. A pump attachment for a container as in claim 1, wherein the spray nozzle comprises an internal discharge passage and an end of the tubing is coupled to the spray nozzle to place the internal discharge passage in communication with the tubing.

6. A pump attachment for a container as in claim 1, wherein the first end of the body includes an internal passage having an inlet end and an outlet end, the outlet end being coupled to the tubing and the inlet end being in fluid communication with the conduit.

7. A pump attachment for a container as in claim 6, wherein the conduit comprises a second flexible tube that extends from the outlet at the second end of the body to the inlet end of the internal passage in the body.

8. A pump attachment for a container as in claim 7, wherein the second flexible tube is connected to the inlet end of the internal passage and the outlet at the second end of the body by barbed fittings.

9. A pump attachment for a container as in claim 1, wherein the shaft extends through the spray nozzle.

10. A pressurized sprayer comprising:

a body defining a chamber and having a first end and a second end and a wall extending between the first end and the second end, the first end of the body being coupled to an opening of a container;

a shaft extending through an opening in the first end of the chamber;

a piston reciprocally mounted within the chamber, the piston including an upper surface and a lower surface, the piston being in sealing engagement with the interior wall of the body, the piston separating the chamber into an upper portion above the upper surface of the piston and a lower portion below the lower surface of the piston;

a handle coupled to the piston through the shaft;

an inlet valve at the second end of the body, the inlet valve configured to permit the flow of fluid into the chamber and restrict the flow of fluid out of the chamber;

a biasing member between the piston and the first end of the chamber, an outlet passage at the second end of the body;

a first conduit in fluid communication with the outlet passage;

an internal passage formed in the first end of the body, the passage having an outlet and an inlet that is coupled to the first conduit to place the passage in communication with the outlet passage, a spray nozzle that comprises an actuator, a discharge outlet, and a flexible second conduit, the second conduit extending between outlet of the internal passage and the discharge outlet to place the discharge outlet in communication with the outlet passage, the actuator being coupled to a spray valve for controlling the flow of chemical through the second conduit;

wherein the second conduit comprises a tubing that extends continuously from a point upstream of the spray valve to a point downstream of the spray valve and wherein when the actuator is in a first position the second conduit passes through the valve substantially unobstructed and in a second position the tubing is pinched closed within the valve.

11. The pressurized sprayer of claim 10, wherein the first and second conduits are flexible.

12. The pressurized sprayer of claim 10, wherein the first conduit extends generally along side the wall of the body.

13. The pressurized sprayer of claim 10, wherein the spray nozzle is configured such that the user can grasp the nozzle and actuate the actuator with one hand while simultaneously rigidly supporting the bottle that is coupled to the pressurized sprayer.

14. The pressurized sprayer of claim 13, wherein the spray nozzle comprises a generally vertically extending support surface that extends in a generally vertical direction and the actuator includes a generally vertically extending actuating surface, the support surface configured to support the palm of the user's hand while the actuator surface supports a finger of the user hand, the actuator being actuated by moving the finger towards the palm of the user's hand.

15. The pressurized sprayer of claim 14, wherein the shaft extends through the spray nozzle such that it extends between the finger and palm of the user when in use.

16. The pressurized sprayer of claim 1, wherein the spray nozzle comprises an internal discharge passage and an end of the second conduit is coupled to the spray nozzle to place the internal discharge passage in communication with the tubing.

17. The pressurized sprayer of claim 16, wherein the second conduit is connected to the internal discharge passage by a barbed fitting.

18. The pressurized sprayer of claim 10, wherein the second conduit is connected to the passage of the body by a barbed fitting.

* * * * *